US005772343A

United States Patent [19]

Beretta et al.

[11] Patent Number: 5,772,343

[45] Date of Patent: Jun. 30, 1998

[54] MEDIA HANDLING SYSTEM FOR DUPLEX PRINTING

[75] Inventors: Robert K. Beretta, Vancouver; Paul W. Martin, Battle Ground; Thomas E. McCue, Jr.; Thomas W. Ruhe, both of Vancouver, all of Wash.

[73] Assignee: Hewlett Packard Company, Palo Alto, Calif.

[21] Appl. No.: 884,885

[22] Filed: Jun. 30, 1997

[51] Int. Cl.[6] ..... B41J 11/58

[52] U.S. Cl. ..... 400/624; 400/636; 400/642; 400/708; 271/259; 271/186; 101/234; 399/401; 355/319

[58] Field of Search ..... 400/624, 625, 400/629, 636, 636.1, 636.2, 636.3, 637, 642, 708; 101/230, 234; 399/401, 402; 355/319; 271/313, 186, 225, 227, 246, 258.01, 259

[56] References Cited

U.S. PATENT DOCUMENTS

| | | | |
|---|---|---|---|
| 4,202,266 | 5/1980 | Zahradnik | 101/234 |
| 4,453,841 | 6/1984 | Bobick et al. | 400/126 |
| 4,956,678 | 9/1990 | Kiya et al. | 355/319 |
| 5,011,313 | 4/1991 | Sato | 400/636.3 |
| 5,155,540 | 10/1992 | Yamada et al. | 355/319 |
| 5,158,380 | 10/1992 | Hauslaib et al. | 400/636 |
| 5,158,381 | 10/1992 | Inomata et al. | 400/624 |
| 5,201,517 | 4/1993 | Stemmle | 271/186 |
| 5,308,175 | 5/1994 | Ito | 400/625 |
| 5,517,228 | 5/1996 | Obu et al. | 347/171 |
| 5,594,486 | 1/1997 | Kiyohara | 400/636 |
| 5,680,651 | 10/1997 | Tsuji et al. | 399/401 |
| 5,708,953 | 1/1998 | Morigasmi et al. | 399/364 |
| 5,730,535 | 3/1998 | Keller | 400/605 |

*Primary Examiner*—Eugene H. Eickholt

[57] ABSTRACT

A metering roller and feed guide are included in a desktop printer between a first roller and a print zone. During first side printing, a media sheet is fed along the first roller and directed by an upper feed guide over the refeed guide to a second roller. The metering roller feeds the media sheet through the print zone. As the trailing edge approaches a metering pinch line, the metering roller stops. After a drying time, the second roller reverses direction moving the media sheet back toward the refeed guide. The refeed guide blocks the original path and directs the media sheet toward a repick guide and the first roller. The media sheet is fed onto the first roller for second side printing. In one embodiment the media sheet is wrapped around the first roller and unwrapped into the input tray during the refeed process to accommodate long media sheets.

51 Claims, 15 Drawing Sheets

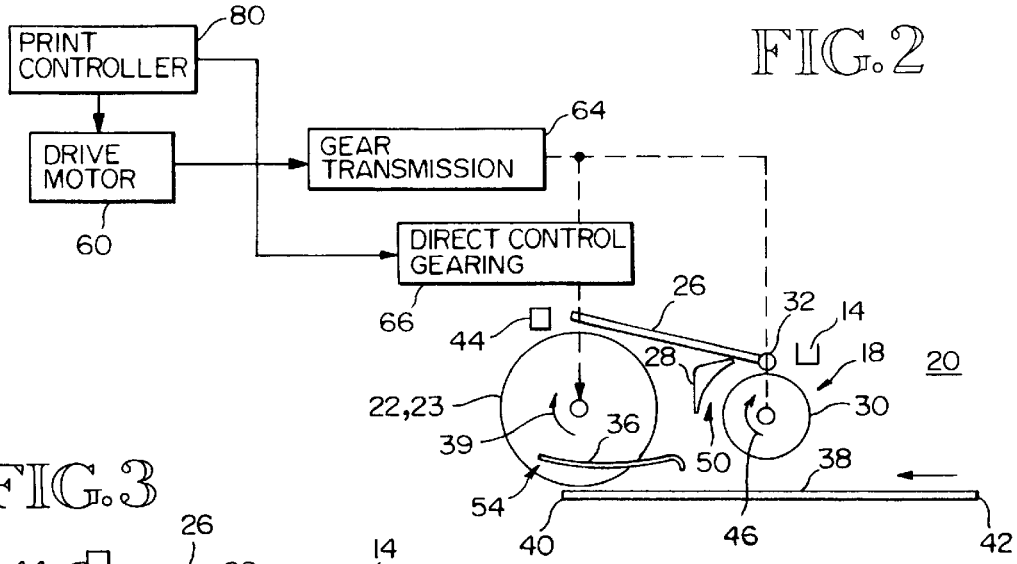
FIG. 2
FIG. 3
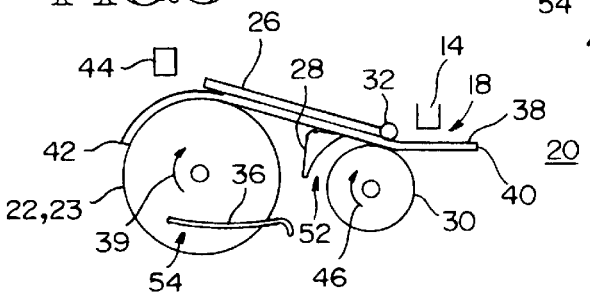
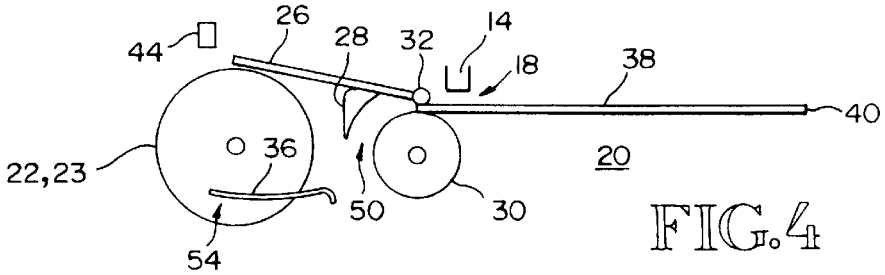
FIG. 4
FIG. 5
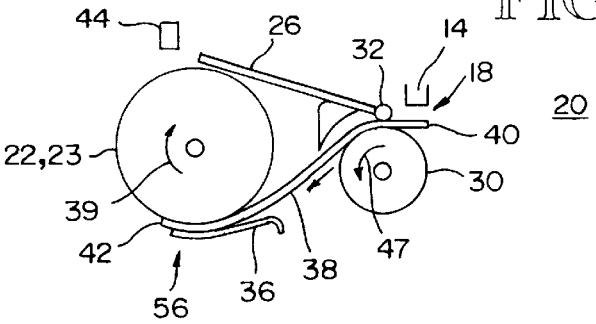
FIG. 6
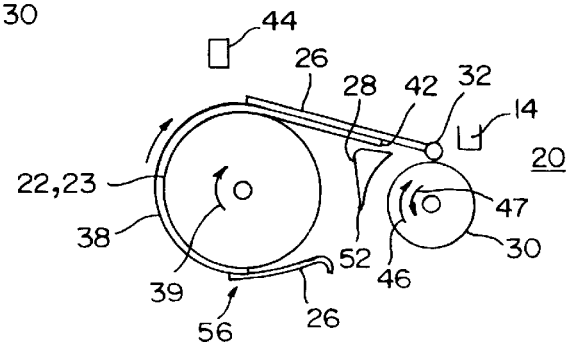

FIG. 10
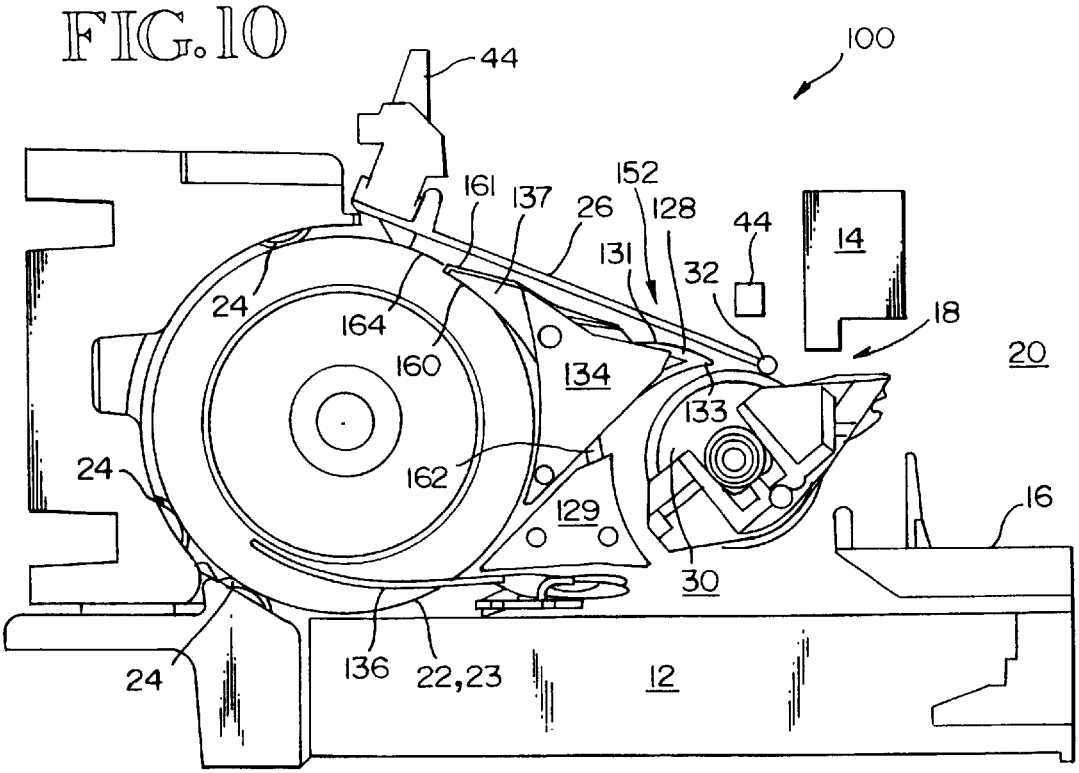
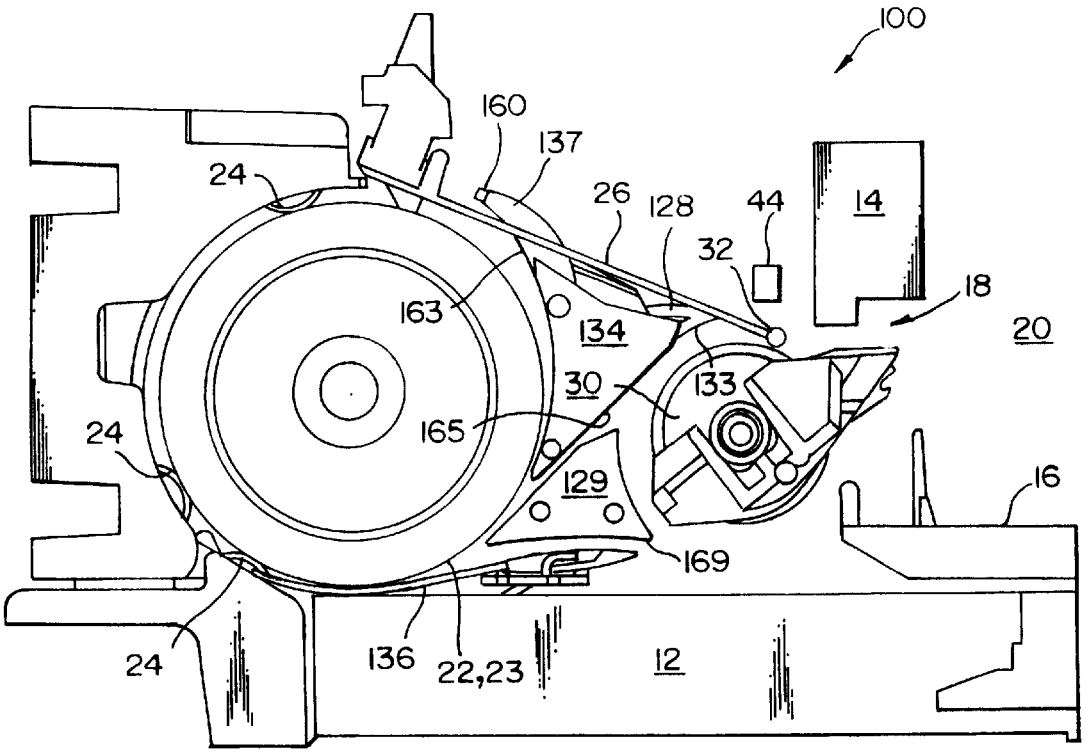
FIG. 11

MEDIA HANDLING SYSTEM FOR DUPLEX PRINTING

BACKGROUND OF THE INVENTION

This invention relates generally to methods and apparatus for printing on two sides of a media sheet, and more particularly, to a media handling system which first feeds a media sheet with a first side exposed to a print source, then feeds the media sheet with a second side exposed to the print source.

Printing to two sides of a media sheet, referred to as duplex printing, is a desirable feature in printing systems. The advantages of duplex printing include reducing the amount of paper required compared to one-sided (simplex) printing, and generating print sets with layouts resembling that of professionally printed books. Conventional duplex printing devices employ complex paper handling mechanisms. Typically, an extra tray is used for temporary storage of pages having printing on a first side. In an alternative approach a second paper path is provided to route a first printed page around the existing paper supply.

Similarly, duplex copying typically is accomplished by either one of two methods. In one method, first side copies are stacked in a duplex tray. When a set of first side copies is complete, the copies are fed out of the duplex tray and returned with an odd number of inversions along a duplex path to receive second side imaging. In an alternative method first side copies are returned directly to receive second side imaging without stacking.

Conventional devices tend to have long paper paths and many parts. It is desirable to achieve a simplified method and apparatus for duplex media handling at a desktop printer.

SUMMARY OF THE INVENTION

According to the invention, duplex printing is achieved for a desktop printer, such as an inkjet printer. According to one aspect of the invention, a metering roller and refeed guide are included in a desktop printer downstream from a first roller, between the first roller and a print zone. A media sheet is fed along a media path through the print zone to receive printing to a first side of the media sheet. The media sheet is picked then fed along the first roller and directed by an upper feed guide over the refeed guide to a second roller, (i.e., the metering roller). A pinch roller is located adjacent to the second roller. The media sheet is metered by the second roller through the print zone into an output region of the printer. A first edge of the media sheet serves as a lead edge during printing to the first side. As the trail edge of the media sheet approaches the pinch line formed between the metering roller and a corresponding pinch roller, the metering roller stops. At such time, the lead edge of the media sheet extends into the output region of the desktop printer. For an inkjet printer, the first side of the media sheet is given time to dry in the air space of the printer output region.

According to another aspect of the invention, printing to the second side of the media sheet is achieved by reversing the rotational direction of the second roller to meter the media sheet back toward the refeed guide. A second edge opposite the first edge serves as the lead edge of the media sheet while being refed and while printing to the second side. As the metering roller moves the media sheet back, the refeed guide blocks the media sheet's lead second edge from traversing back along the original media path. Instead the refeed guide directs the lead second edge downward toward a repick guide. The media sheet is fed along the refeed guide and repick guide by the metering roller. As the lead second edge reaches the first roller, the first roller picks the media sheet to refeed the media sheet for second side printing.

According to another aspect of the invention, the media sheet with the second edge as the lead edge is fed along the first roller and directed by the upper feed guide over the refeed guide to the second roller, then through the print zone for printing to the second side. In an embodiment for short forms duplex printing, the media sheet is fed from the first roller directly over the refeed guide and second roller into the print zone. Then, like for first side printing, the second roller meters the media sheet through the print zone and into the output region to allow the second side to be printed. For portrait mode printing, the image is inverted for printing to the second side. This is because the lead edge of the media sheet during second side printing is the media sheet edge adjacent to the bottom portion of the second side image for a portrait mode print job. This completes the duplex printing cycle.

In another embodiment the method and printer vary to accommodate longer media sheets. Like in the first embodiment, once the first side is printed, the media sheet extends into the output region. After a drying time elapses, the rotational direction of the second roller is reversed. The second edge of the media sheet now serves as the lead edge. The media sheet is fed back toward a refeed guide. According to an aspect of the invention, the refeed guide directs the second edge downward onto a middle guide, which in turn directs the second edge onto a repick guide. The first roller then picks the media sheet from the repick guide.

According to another aspect of the invention, the media sheet is fed onto and wrapped around the first roller until the first edge of the media sheet (now the trailing edge) clears the middle guide. As the media sheet is fed around the first roller, a first end of one or more wrap-around finger guide members (also referred to as wrap around fingers or fingers) near the upper feed guide block the lead second edge from progressing off the first roller to the refeed guide and second roller. Instead, the wrap around fingers direct the second edge to continue around the first roller. As the media sheet continues to be fed, the media sheet overlaps itself in the vicinity of the second edge. The amount of overlap depends upon the length of the media sheet and the circumference of the first roller. While the media sheet is wrapping around the first roller, there comes a time when the media sheet trail first edge clears the middle guide and remains on the repick guide. At such time the direction of the first roller is reversed to begin unwrapping the media sheet.

The media sheet unwraps into an input region of the printer (e.g., the input tray or an area adjacent to the input tray). Specifically, the media sheet moves back along the repick guide, under the middle guide, and into the input region. In effect the media sheet has been flipped compared to when it was first picked from the input tray for first side printing. During the unwrapping the media sheet clears the wrap-around finger members, releasing the fingers to move to their inactive position.

The media sheet continues unwrapping into the input region until the second edge of the media sheet is detected by a top of form paper sensor. The first roller then changes direction again to the original direction and feeds the media sheet along the first roller with the second edge as the lead edge and the second side exposed for printing. At the time that the first roller resumes rotating in its original direction the wrap around fingers are at the inactive position. As a result, the media sheet is fed from the first roller along the upper feed guide, over the wrap around fingers, and over the refeed guide to the second roller. The second roller then meters the media sheet through the print zone and into the output region of the printer to allow the second side to be printed. This completes the duplex printing cycle.

According to another aspect of the invention, the wrap around fingers move between a first position (e.g., inactive position) and a second position (e.g., wrap around guide position). Each wrap around finger is biased to the first position by gravity or a spring. While in the first position, the wrap around fingers allow a media sheet coming off the first roller to advance between the upper feed guide and a surface of the refeed guide toward the second roller. While in the second position, the wrap around fingers direct the media sheet to wrap around the first roller and have the media sheet overlap itself.

Each wrap around finger has a first end which while the finger is in the first position moves below a surface level of the first roller, and while the finger is in the second position moves into an opening of the upper feed guide (e.g., blocking the media path along the upper feed guide). Each finger has a second end opposite the first end. While a finger is in the first position, the second end extends to the middle guide. During second side feeding, when the second roller reverses withdrawing the media sheet from the output region, the media sheet moves under the refeed guide to the middle guide. The second edge of the media sheet pushes the second end of the wrap around fingers, moving the wrap around fingers from the first position to the second position.

According to another aspect of the invention, a media sheet handling system for enabling printing to a first side and a second side of a media sheet, includes a first roller which feeds the media sheet along a first path toward a print zone. The media sheet has a first edge and a second edge opposite the first edge. A second roller is located along the first path between the first roller and the print zone. The second roller receives a lead edge of the media sheet as the media sheet progresses along the first path from the first roller to the second roller. During printing to the first side of the media sheet during a duplex printing operation, the second roller rotates in a first direction to advance the media sheet into the print zone. The second roller discontinues rotation in the first direction after printing to the first side is complete and while a portion of the media sheet remains in contact with the second roller.

The system also includes a refeed guide located along the first path between the first roller and the second roller. The refeed guide is movable between a first position and a second position, and is biased toward the first position. Action of the media sheet passing over the refeed guide along the first path moves the refeed guide into the second position.

A first signal triggers the second roller to change direction to rotate in a second direction opposite the first direction while the portion of the media sheet remains in contact with the second roller. The second roller moves the media sheet back toward the refeed guide while rotating in the second direction. The second edge of the media sheet is the lead edge during movement of the media sheet back toward the refeed guide. The refeed guide is positioned in the second position blocking the first path when the second edge serving as the lead edge contacts the refeed guide during the movement of the media sheet back toward the refeed guide. The refeed guide directs the media sheet along a second path toward the first roller. The media sheet is re-fed around the first roller along the first path to the second roller and through the print zone to receive print onto the media sheet second side.

According to another aspect of the invention the system also includes an output region. At least a portion of the media sheet is fed through the print zone and into the output region during printing to the media sheet first side and during printing to the media sheet second side. For duplex printing the media sheet is released into the output region after printing to the media sheet second side.

According to another aspect of the invention the print zone is adjacent to the second roller between the second roller and the output region.

According to another aspect of the invention, the system also includes a repick guide along the second path in the vicinity of the first roller. The repick guide moves between a repick guide first position and a repick guide second position, and is biased to the repick guide first position. The refeed guide directs the lead second edge of the media sheet onto the repick guide while the second roller rotates in the second direction. The repick guide directs the lead second edge to the first roller to enable the first roller to pick the media sheet at the lead second edge. The repick guide moves into the repick guide second position between a time that the lead second edge of the media sheet moves onto the repick guide and a time where the lead second edge advances beyond the repick guide along the first roller.

According to another aspect of the invention, the system also includes a middle guide positioned along the second path between the first roller and the second roller. The refeed guide directs the lead second edge of the media sheet toward the middle guide while the second roller rotates in the second direction.

According to another aspect of the invention, the system also includes a wrap around finger guide member (also referred to herein as a wrap around finger, or finger) having a first portion and a second portion. The wrap around finger guide member has a first surface and a second surface at the first portion. The wrap around finger guide member is movable between a finger guide first position and a finger guide second position, and is biased toward the finger guide first position. The wrap around finger guide member is located between the first roller and the second roller. The first portion extends toward the first path. The second portion extends toward the middle guide and second path. While the wrap around finger guide member is in the finger guide first position the second portion extends into the second path. While the wrap around finger guide member is in the finger guide second position the first portion extends into and blocks the first path. While the second portion extends into the second path, contact with the media sheet moving along the second path pushes the finger guide member at the second portion out of the second path and from the finger guide first position into the finger guide second position.

One advantage of the invention is that the wrap around finger guide members allow the media sheet to be wrapped around the first roller so as to enable duplex printing to media sheets longer than a path length from the second roller back around the first roller and back to the second roller. Another advantage is that the media sheet is not released between the time the first side is printed and the time the media sheet starts to be re-fed back toward the upper feed guide and first roller. Another advantage is that a drying time is included for wet ink printing to allow time for the first side of the media sheet to dry before printing to the second side of the media sheet. Another advantage of the invention is that the gravity biasing of the refeed guide enables the refeed guide to provide directional control of the media sheet without interfering with single-side printing operations. Another advantage is that the wrap around finger guide members are activated by the media sheet moving through the second path. Another advantage of the invention is that the repick guide is located so as not interfere with the original pick process. These and other aspects and advantages of the invention will be better understood by reference to the following detailed description taken in conjunction with the accompanying drawings.

BRIEF DESCRIPTION OF THE DRAWINGS

FIG. 2 is a diagram of print drive components and media handling components for the printer of FIG. 1 prior to a print job;

FIG. 3 is a diagram of media handling components for the printer of FIG. 1 for printing to the first side of a media sheet;

FIG. 4 is a diagram of the media handling components of FIG. 3 at a time between first side printing and second side printing;

FIG. 5 is a diagram of the media handling components of FIG. 3 during refeeding of the media sheet for second side printing;

FIG. 6 is a diagram of the media handling components of FIG. 3 showing the media sheet fed toward the print zone for second side printing;

FIG. 10 is a planar side view of a portion of an inkjet printer according to another embodiment of this invention showing the refeed guide, repick guide and a wrap around finger in respective first positions;

FIG. 11 is another planar side view of the printer of FIG. 10 showing the refeed guide, repick guide and a wrap around finger in respective second positions;

DESCRIPTION OF SPECIFIC EMBODIMENTS

Overview

Figure 1:
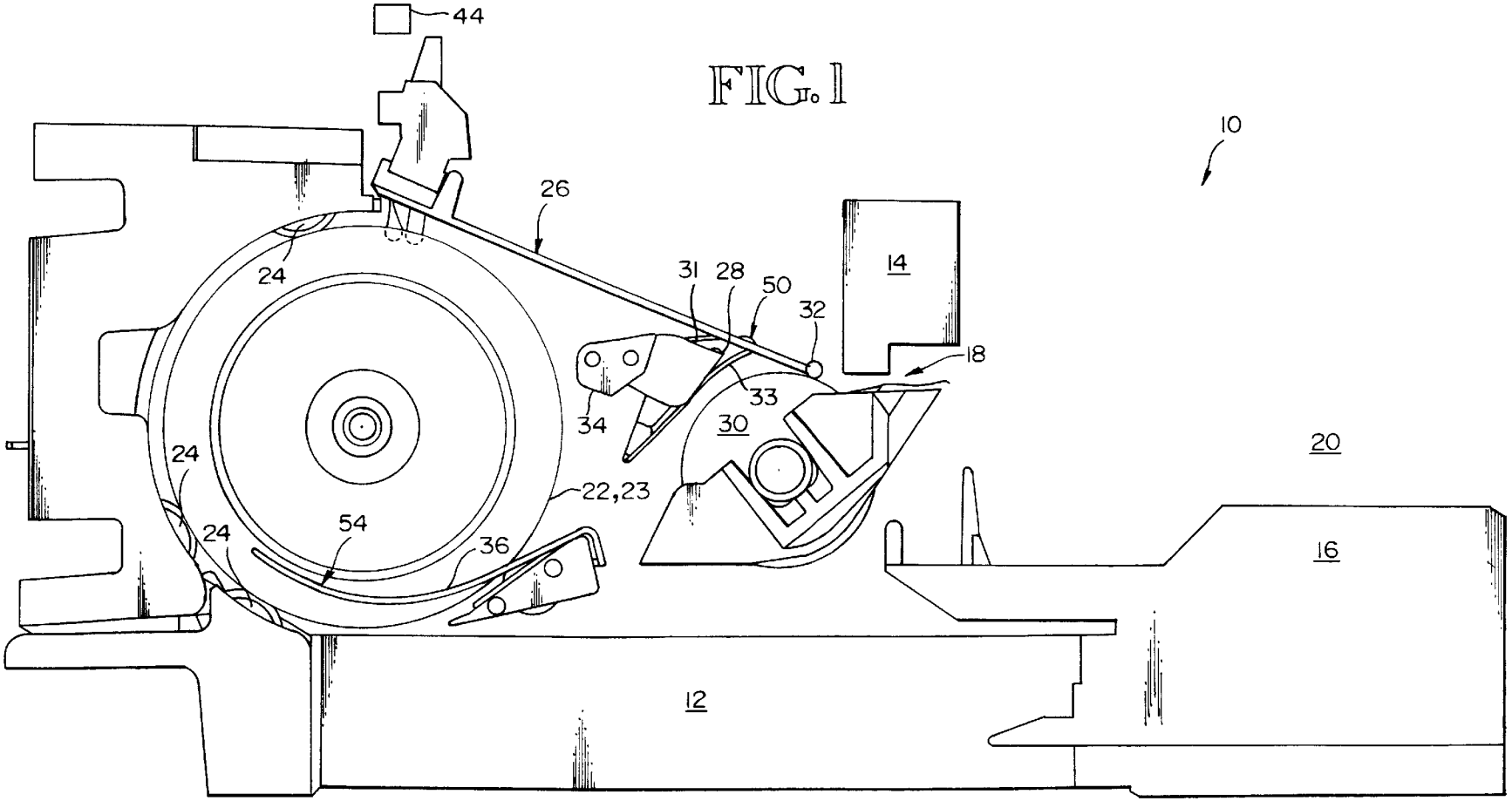
FIG. 1 is a planar side view of a portion of an inkjet printer according to an embodiment of this invention.

FIG. 1 shows an inkjet printer 10 according to an embodiment of this invention. The printer 10 includes a media handling system for routing a media sheet to print first to one face of the media sheet (i.e., first side), then to an opposite face of the media sheet (i.e., second side). The printer 10 includes an input tray 12, the media handling system, one or more inkjet pens 14, and an output tray 16. A media sheet is picked from the input tray 12 and fed along a media path by the media handling system to a print zone 18 where a first face of the media sheet receives print. During such feed and print operations a first edge of the media sheet serves as a lead edge and a second edge serves as a trail edge. The media sheet continues along the media path into an output region 20 above the output tray 16. For single sided printed, the media sheet is released into the output tray 16. For two sided printing (also referred to as duplex printing), the media sheet is not released into the output tray 16. Instead the media sheet is moved back in the media handling system with the second edge now serving as the lead edge and the first edge now the trail edge. When the media sheet advances into the print zone the second face receives print. The media sheet then is fed into the output region 20 and the output tray 16.

Media Handling System and Method for Duplex Printing

Figure 7:
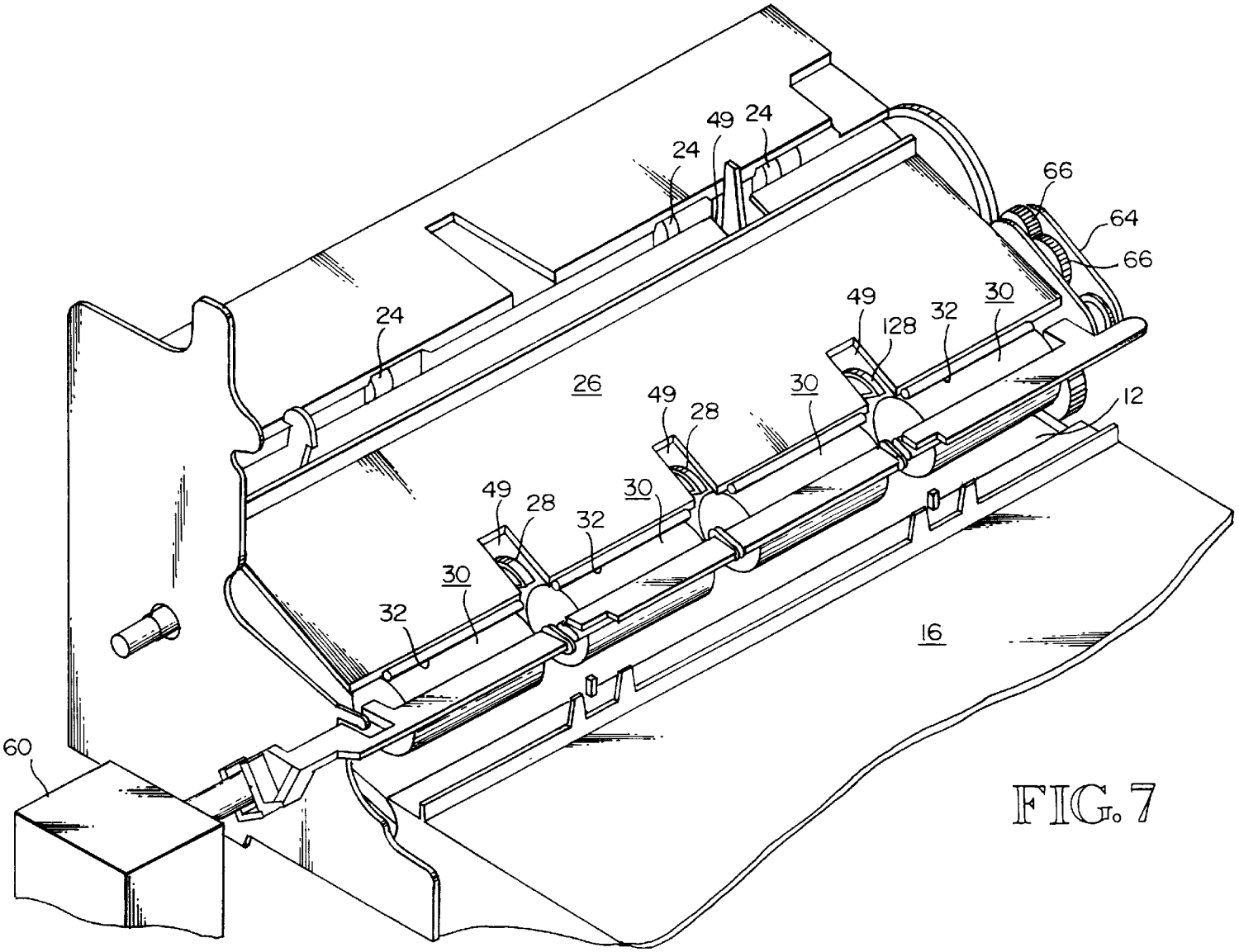
FIG. 7 is a perspective view of the printer of FIG. 1.
Figure 8:
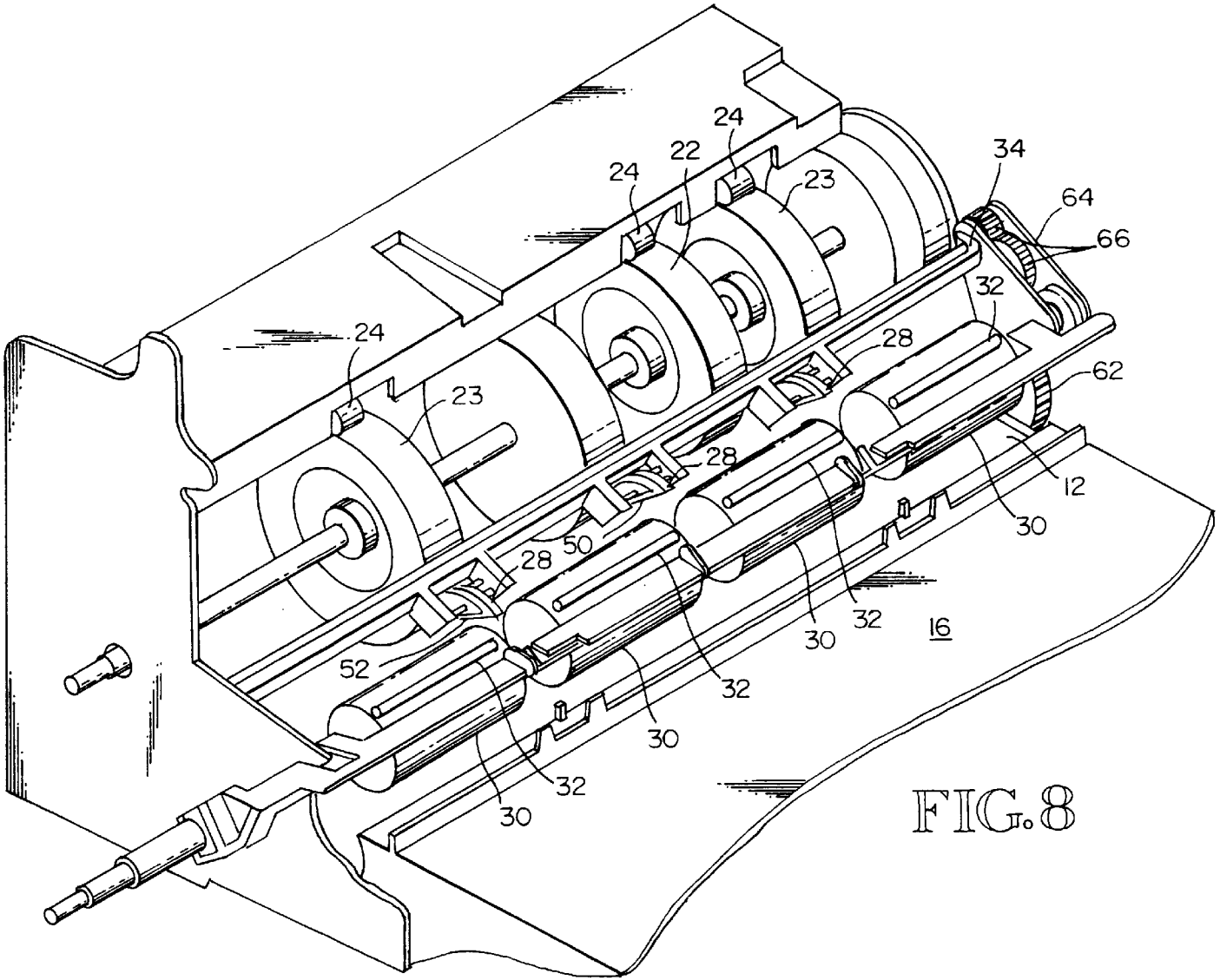
FIG. 8 is a perspective view of the printer of FIG. 7 with the upper feed guide removed.
Figure 9:
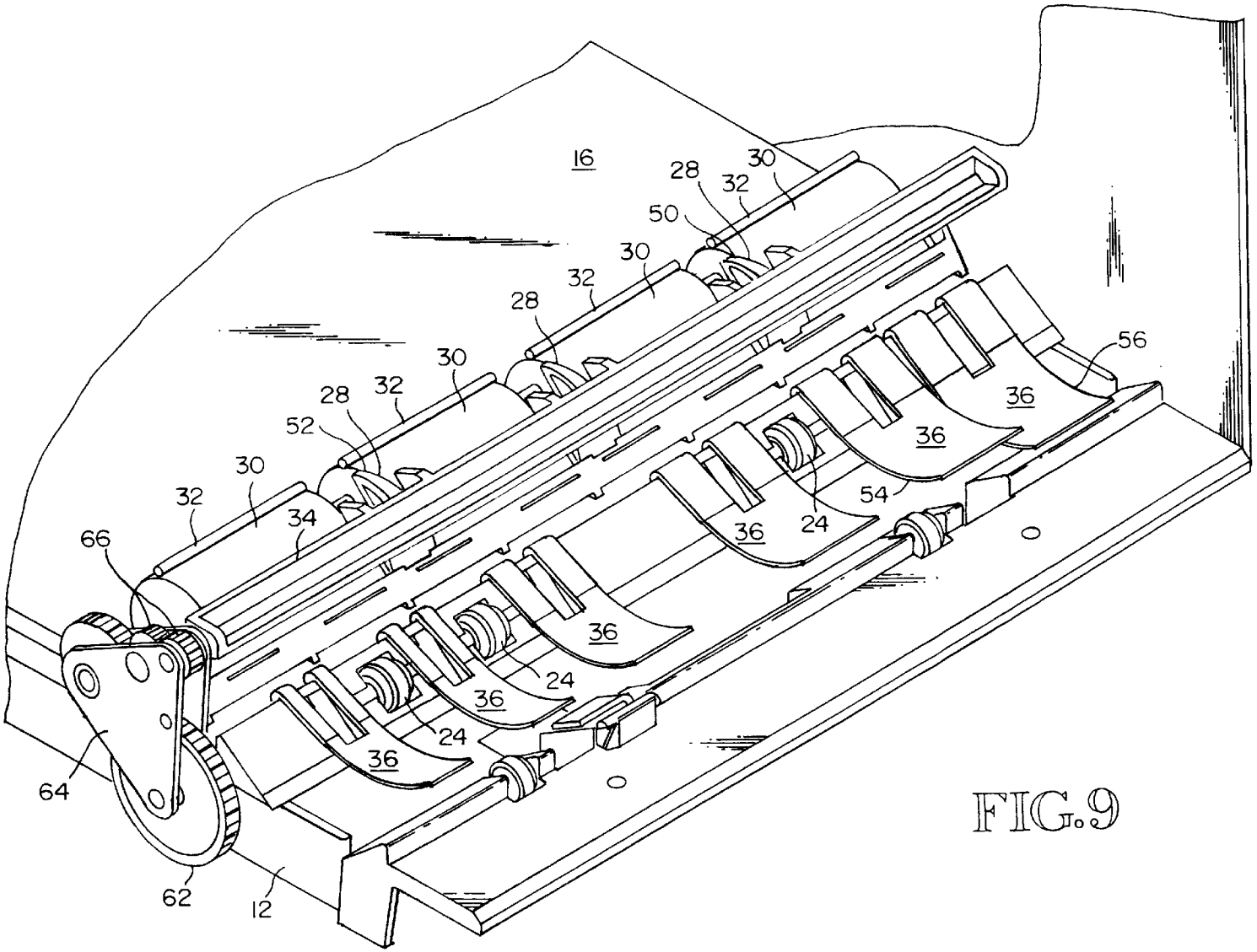
FIG. 9 is a perspective view of the printer of FIG. 7 with the upper feed guide and pick and feed rollers removed.

Referring to FIGS. 1–9, the media handling system includes pick and feed rollers 22, 23, feed idler rollers 24, an upper feed guide 26, a refeed guide 28, metering rollers 30, metering pinch rollers 32, and a repick guide 36. The refeed guide 28 is movable between a first position and a second position. The refeed guide 28 is biased by gravity into the first position. FIG. 1 shows the refeed guide 28 in the first position. FIGS. 7–9 show refeed guides 28 in the first position 50 and the second position 52. Although one refeed guide 28 is shown in the first position 50 and another in the second position 52 in FIGS. 7–9, in use at any given time for a media sheet spanning all the refeed guides 28, the refeed guides 28 are in the same position. The repick guide 36 also is movable between a first position and a second position, and is spring-biased into the first position. FIG. 1 shows the repick guide 36 in the first position. FIG. 9 shows repick guides 36 in the first position 54 and the second position 56.

Although one repick guide 36 is shown in the first position 54 and another in the second position 56 in FIG. 9, in use at any given time for a media sheet spanning across all the repick guides 36, the repick guides 36 are in the same position. The repick guide 36 is positioned so as not to interfere with the process of picking a media sheet from the input tray 12. While a media sheet is picked from the input tray 12, the repick guide is in the first position 54 away from the picked edge of the media sheet. While the repick guide 36 is down in the second position 56, a media sheet is not picked from the input tray, but instead is being refed from the output region 20 and metered rollers 30 over the repick guide 36.

Duplex printing according to one embodiment of the inventive method is described below with regard to FIGS. 1–6. A media sheet 38 is picked from the input tray 12 by the pick roller 22 (see FIG. 2). The pick and feed rollers 22, 23 rotate in a first direction 39 feeding the media sheet around the pick and feed rollers 22, 23 along a media path. Initially, the refeed guide 28 and repick guide 36 are in the first position (see FIG. 2). A first edge 40 of the media sheet 38 serves as the lead edge as the media sheet 38 is fed along the media path toward the print zone 18. As the media sheet 38 is fed around the pick and feed rollers 22, 23 the upper feed guide 26 directs the media sheet toward the refeed guide 28 and the metering rollers 30. The first edge 40 of the media sheet encounters the refeed guide 28 in the media path. The movement of the media sheet rotates the refeed guide 28 from the first position to the second position (see FIG. 3). The lead first edge 40 then is captured between pinch rollers 32 and the metering rollers 30. The metering rollers 30 rotate in a first direction 46 to meter the media sheet 38 through the print zone 18 into the output region 20. As the media sheet moves through the print zone 18, a first side of the media sheet receives print. As a second edge 42, which is the trail edge, passes beyond the refeed guide 28, the refeed guide rotates under the force of gravity back to its first position (see FIG. 4). An edge sensor 44 detects the passing of the first edge 40, then second edge 42, as the media sheet 38 is fed along the media path during first side printing. The printer controller 80 receives the edge sensor 44 indications, and determines the media sheet length.

Once the second edge 40 is detected, the metering rollers 30 meter the media sheet 38 a predetermined amount more to complete printing to the first side. The metering rollers 30 then stop the movement of the media sheet 38, while the media sheet 38 in the vicinity of the second edge 40 remains pinched between the metering rollers 30 and the pinch rollers 32 (see FIG. 4). The metering rollers pause rotation for a prescribed time delay for at least partial drying of the media sheet.

The metering rollers 30 then reverse direction to rotate in a second direction 47 and move the media sheet 38 back toward the refeed guide 28. The refeed guide 28 blocks the original media path and guides the media sheet 38 down toward the repick guide 36. As the media sheet 38 is fed back, the second edge 42 is now the lead edge and the first edge 40 is now the trail edge. As the media sheet 38 encounters and moves along the repick guide 36 toward the pick and feed rollers 22, 23, the media sheet 38 moves the repick guide 36 from the first position 54 to the second position 56 (see FIG. 5). The pick and feed rollers 22, 23 continue to rotate in the first direction 39 feeding the media sheet around the rollers 22, 23 toward the upper feed guide 26.

The media sheet is fed with the second edge 42 as the lead edge along the upper guide 26 into the path of the refeed guide 28. The movement of the media sheet 38 and the contact of the second edge 42 moves the refeed guide 28 from the first position to the second position (see FIG. 6). According to this embodiment the length of the media sheet 38 is limited for duplex printing. An alternative embodiment without such limitation is described below in a separate section. For the embodiment of FIGS. 1–9, the trail first edge 40 needs to clear the metering rollers 30 and allow time for the metering rollers 30 to reverse direction from the second direction 47 back to the original first direction 46 before the lead edge 42 reaches the metering rollers 30. Referring to FIG. 7, the maximum length of a media sheet to receive duplex printing for the embodiment shown in FIGS. 1–9 is the length from the pinch rollers 32 back along the media path between the upper feed guide 26 and refeed guide 28 around the pick and feed rollers 22, 23 along repick guide 36 back toward the metering rollers 30 to the pinch rollers 32. Preferably the media sheet is somewhat shorter than such maximum length allowing time for the trail first edge 40 to clear the pinch rollers 32 and time for the metering rollers 30 to change direction back to the first direction 46, before the lead edge 42 reaches the pinch rollers 32.

Because the print controller 80 has determined the length of the media sheet, and because the path length from the metering rollers 30 back to the pick and feed rollers 22, 23 is known, and the circumference of the pick and feed rollers 22, 23 are known, the print controller is able to determine when the media sheet has cleared the metering rollers 30 as the media sheet is fed back for second side printing. Once the trail first edge 40 clears the pinch line defined by the metering rollers 30 and pinch rollers 32, the metering rollers 30 reverse direction back to the original first direction 46. The media sheet 38 is fed with the second edge 42 as the lead edge and the first edge as the trail edge. Further, the media sheet 38 is fed around the pick and feed rollers 22, 23, between the upper feed guide 26 and refeed guide 28, onto the metering rollers 30 and into the print zone 18. As the media sheet is fed through the print zone with the second edge 42 as the lead edge, a second side of the media sheet 38, opposite the first side, receives print. The media sheet 38 is fed through the print zone 18 into the output region 20 and output tray 16 of the printer 10.

Referring to FIG. 2 a drive motor 60 is shown with gear transmission 64 for driving the metering rollers 30 and the pick and feed rollers 22, 23. A gear pair 66 and gear 62 for controlling the relative directions of the metering rollers 30 compared to the pick and feed rollers 22, 23 also are included. During first side printing, the drive motor drives the metering rollers 30 and pick and feed rollers 22, 23 in a first direction via the gear transmission 64. The direction control gear pair 66 is disengaged and the gear 62 is engaged so that the pick and feed rollers 22, 23 rotate in the same direction as the metering rollers 30. The drive motor stops after the first side is printed to allow time for the first side to dry. While the first side is drying the trail edge of the media sheet is pinched between the metering rollers 30 and the pinch rollers 32. To move the media sheet back along the second path to be repicked by the pick roller 22, the motor direction is reversed, the direction control gear pair 66 is engaged and the gear 62 is disengaged. This causes the metering rollers 30 to rotate in a reverse second direction 47, while the pick and feed rollers 22, 23 rotate in the original direction 39. The direction 47 is opposite the direction 39. Once the media sheet clears the second roller, the motor direction returns to the forward direction, the direction control gear pair 66 is disengaged and the gear 62 is engaged. This causes the metering rollers 30 to rotate in the original first direction 46 with the pick and feed rollers 22, 23. The media sheet is then fed along the first path from the pick and feed rollers 22, 23, over the metering rollers 30 and through the print zone for second side printing. The pick and feed rollers 22, 23 and the metering rollers 30 rotate in the same direction while the media sheet is fed through the print zone for second side printing.

Referring to FIGS. 1, 8 and 9 a refeed guide mount 34 suspends the refeed guides 28 under the upper guide 26, between the pick/feed rollers 22, 23 and the metered rollers 30. The mount 34 is coupled to side chassis walls of the printer 10.

Referring to FIGS. 1 and 7, the upper feed guide 26 is shown as an elongated guide mechanism over the pick and feed rollers 22, 23 between the metering rollers 30 and the pick and feed rollers 22, 23. The upper feed guide 26 includes a plurality of openings 49. The edge sensor 44 detects a media sheet edge through one of the openings 49.

The refeed guide 28 is shown in FIGS. 7–9 as multiple guides. Each guide 28 moves between a first position 50 and a second position 52. While in the first position 50 the refeed guides 28 protrude into openings 49 (see FIG. 7) of the upper feed guide. While in the second position 52, a media sheet moves from the pick and feed rollers over a first surface 31 of the refeed guides 28 to the metering rollers 30 and into the print zone 18 (see FIGS. 1 and 3). The media sheet meets the refeed guides 28 in the second position 52 when withdrawn from the output region 20 and refed back for second side printing. As the media sheet is fed back by the metering rollers 30 the media sheet moves along a second surface 33 (see FIGS. 1 and 5) of the refeed guides 28.

Alternative Media Handling System and Method for Duplex Printing

FIG. 10 shows an inkjet printer 100 according to an alternative embodiment of this invention. The printer 100 includes a media handling system for routing a media sheet to print first to one face of the media sheet, then to an opposite face of the media sheet. Like parts of printer 100 and printer 10 are given the same part numbers. The printer 100 includes an input tray 12, the media handling system, an inkjet pen 14, and an output tray 16. Like for the printer 10 embodiment, in the printer 100 a media sheet is picked from the input tray 12 and fed along a media path by the media handling system to a print zone 18 where a first face of the media sheet receives print. During such feed and print operations a first edge of the media sheet serves as a lead edge and a second edge serves as a trail edge. The media sheet continues along the media path into an output region 20 above the output tray 16. For single sided printing (i.e., simplex printing), the media sheet is released into the output tray 16. For two sided printing (also referred to as duplex printing), the media sheet is not released into the output tray 16. Instead the media sheet is moved back in the media handling system with the second edge now serving as the lead edge and the first edge now the trail edge. The media sheet eventually advances again into the print zone with the second face exposed to receive print. The media sheet is fed into the output region 20 and the output tray 16 to complete the duplex printing process.

Figure 18:
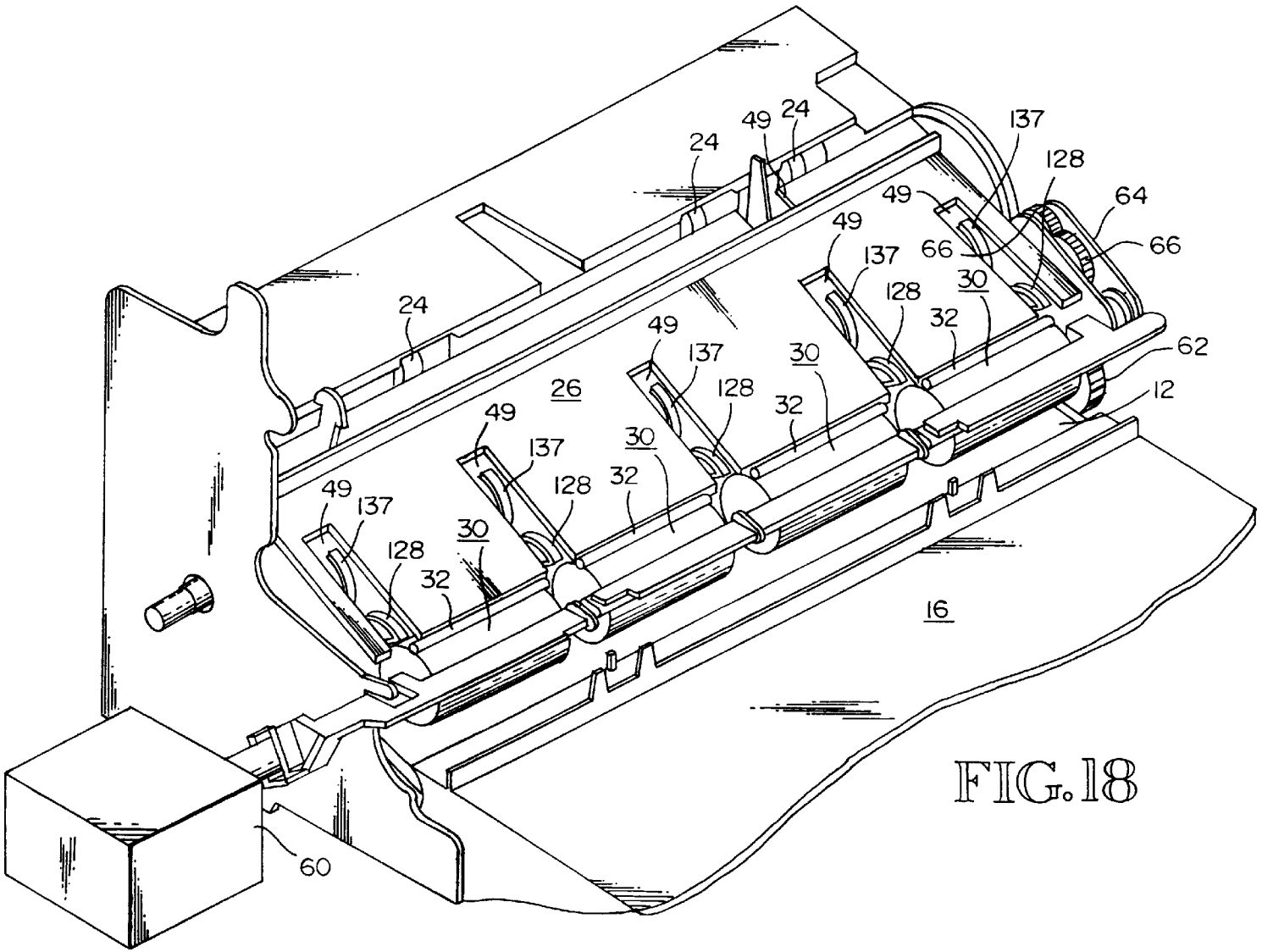
FIG. 18 is a perspective view of the printer of FIG. 10.
Figure 19:
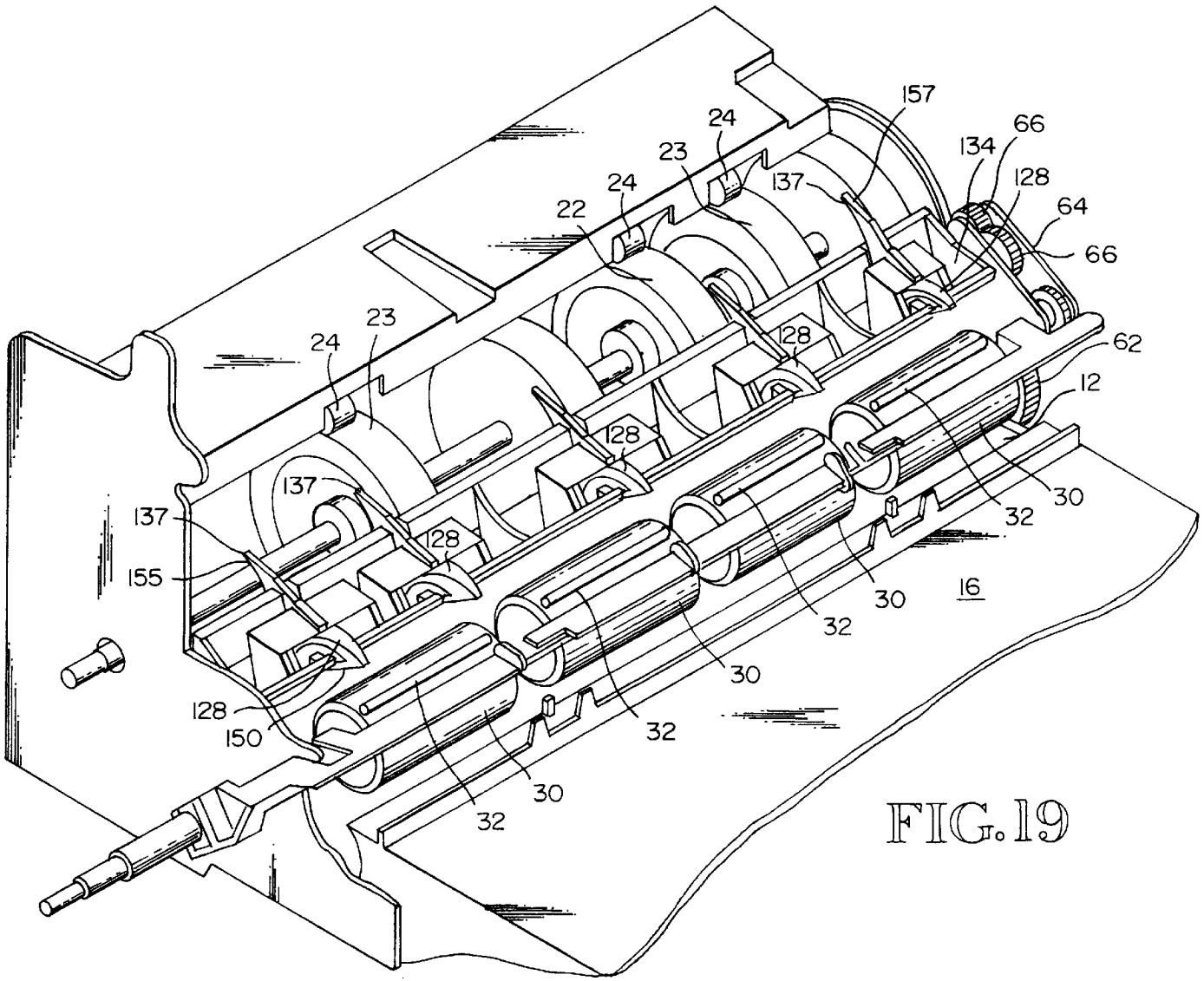
FIG. 19 is a perspective view of the printer of FIG. 18 with the upper feed guide removed.
Figure 20:
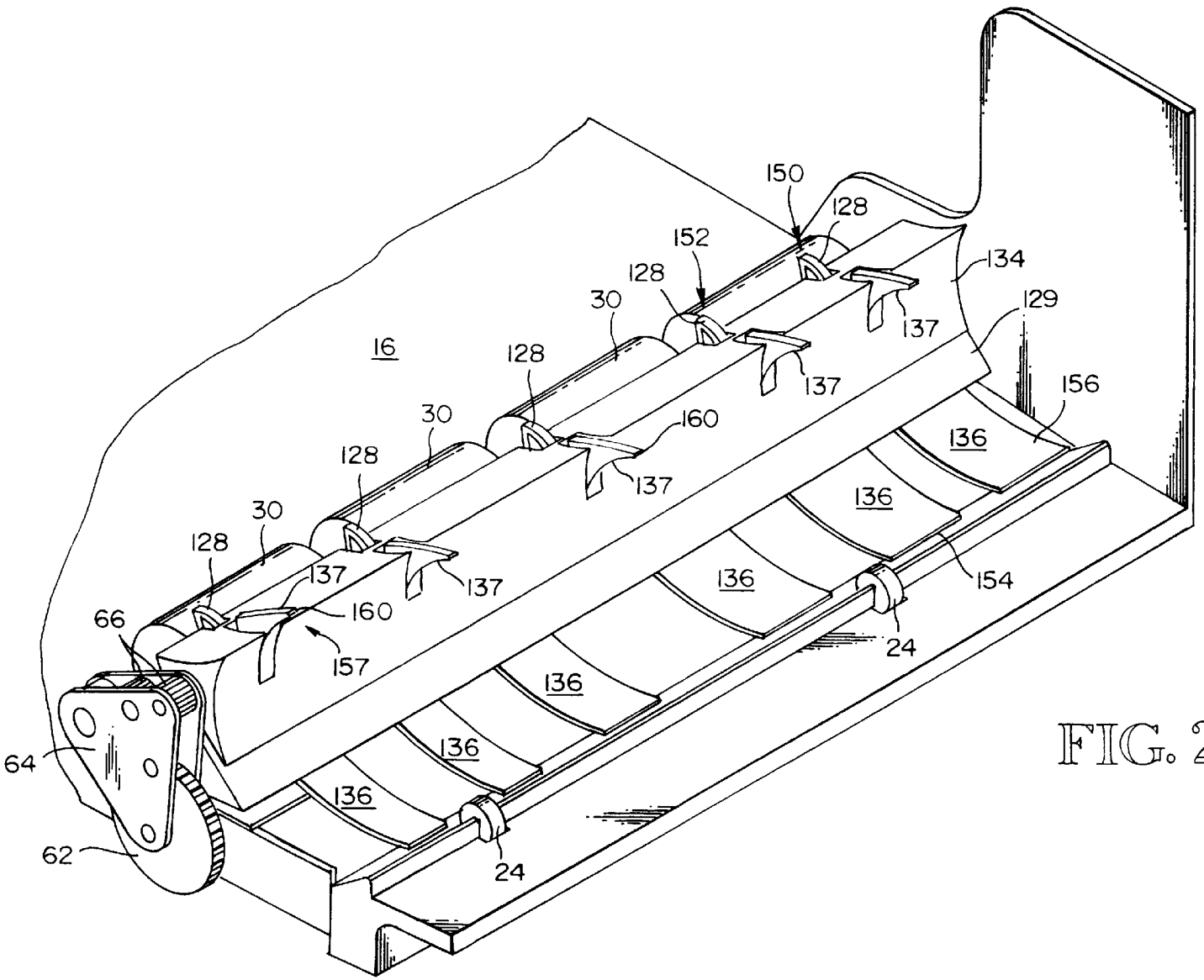
FIG. 20 is a perspective view of the printer of FIG. 18 with the upper feed guide and pick and feed rollers, and rear guide removed.

Referring to FIGS. 10–20, the media handling system of printer 100 includes pick and feed rollers 22, 23, feed idler rollers 24, an upper feed guide 26, metering rollers 30, and metering pinch rollers 32. The media handling system also includes refeed guides 128, middle guide 129, repick guides 136 and wrap around finger guide members 137 (also referred to as wrap around finger 137 or fingers 137). The refeed guides 128 are movable between a first position and a second position and are biased by gravity into the first position. FIG. 10 shows a refeed guide 128 in the second position 152. FIG. 11 shows the refeed guide 128 in the first position 150. FIGS. 18–20 show refeed guides 128 in the first position 150 and the second position 152. Although one refeed guide 128 is shown in the first position 150 and another in the second position 152 in FIGS. 18–20, in use at any given time for a media sheet spanning all the refeed guides 128, the refeed guides 128 are in the same position.

The middle guide 129 is stationary and located between the pick/feed rollers 22, 23 and the metering rollers 30. A media sheet does not encounter the middle guide 129 during simplex printing or printing to a first side of a media sheet.

The repick guide 136 is movable between a first position and a second position, and is spring-biased into the first position. FIG. 10 shows the repick guide 136 in the first position. FIG. 11 shows the repick guide 136 in the second position. FIG. 20 shows multiple repick guides 136 in the first position 154 and the second position 156. Although one repick guide 136 is shown in the first position 154 and another in the second position 156 in FIG. 20, in use at any given time for a media sheet spanning across all the repick guides 136, the repick guides 136 are in the same position. The repick guide 136 is positioned so as not to interfere with the process of picking a media sheet from the input tray 12. While a media sheet is picked from the input tray 12, the repick guide 136 is in the first position 154 away from the picked edge of the media sheet. While the repick guide 136 is down in the second position 156, a media sheet is not picked from the input tray, but instead is being refed from the output region 20 and metered rollers 30 over the repick guide 136.

The wrap around finger guide members 137 also are movable between a first position and a second position. Each wrap around finger guide member 137 is gravity biased into the first position. FIG. 10 shows a wrap around finger 137 in the first position. FIG. 11 shows the wrap around finger in the second position. FIGS. 18–20 show wrap around fingers 137 in the first position 155 and the second position 157. Although one wrap around finger 137 is shown in the first position 155 and another in the second position 157 in FIGS. 18–20, in use at any given time for a media sheet spanning across all the wrap around fingers 137, the wrap around fingers 137 are in the same position. When printing to the second side of a media sheet the media sheet moves the wrap around fingers 137 into the second position 157. When in the second position 157, the wrap around fingers 137 direct the media sheet to continue around the pick/feed roller 22, 23 causing the media sheet to overlap itself.

Each wrap around finger 137 has a first end 160 which, while the finger 137 is in the first position 155, moves within an outer cylinder level of the pick and feed rollers 22, 23 toward a central axle of the pick and feed rollers 22,23. While the fingers are in the first position 155, second ends 162 of the fingers 137 extend to the middle guide 129. As a media sheet moves along the pick and feed rollers 22, 23, the media sheet feeds over a first surface 161 of the wrap around fingers at the first end 160 toward the upper feed guide 126 and refeed guide 128. When the metering roller 30 reverses and the media sheet 38 moves under the refeed guide 128 to the middle guide 129, the second edge 42 of the media sheet pushes the second end 162 of the wrap around fingers, moving the wrap around fingers into the second position 157. While the wrap around fingers 137 are in the second position 157, the first end 160 moves into the upper feed guide 126 so as to block the media path along the upper feed guide 126 in the direction of the metering roller 30. As a media sheet is fed around the pick and feed rollers 22, the wrap around fingers 137 guide the media sheet to continue around the pick and feed rollers 22, 23 and cause the media sheet to overlap itself. The media sheet moves along a second surface 163 (see FIGS. 11 and 15) of the wrap around fingers when wrapping around the pick and feed rollers 22, 23.

Referring to FIGS. 10 and 11 a refeed guide mount 134 suspends the refeed guides 128 and wrap around fingers 137 under the upper feed guide 26 at a location between the pick/feed rollers 22, 23 and the metered rollers 30. The mount 134 is coupled to side chassis walls of the printer 100.

A duplex printing method embodiment for the printer 100 is described below with regard to FIGS. 12–17. A media sheet 38 is picked from the input tray 12 by the pick roller 22. The pick and feed rollers 22, 23 rotate in a first direction 39 feeding the media sheet around the pick and feed rollers 22, 23 along a media path. Initially, the refeed guide 128, repick guide 136 and wrap around fingers 137 are in the first position (see FIG. 10). A first edge 42 of the media sheet 38 serves as the lead edge as the media sheet 38 is fed along the media path toward a print zone 18. As the media sheet 38 is fed around the pick and feed rollers 22, 23 the upper feed guide 26 directs the media sheet toward the refeed guide 128 and the metering rollers 30. The first edge 40 of the media sheet passes over the first surface 161 (labelled in FIG. 10) of the wrap around fingers 137 and then encounters the refeed guide 128 in the media path. The movement of the media sheet 38 rotates the refeed guide 128 from the first position 150 to the second position 152 (see FIG. 12). The lead first edge 40 moves over a first surface 131 of the refeed guide 128 then is captured between pinch rollers 32 and the metering rollers 30. The metering rollers 30 rotate in a first direction 46 to meter the media sheet 38 through the print zone 18 into the output region 20. As the media sheet moves through the print zone 18, a first side of the media sheet receives print. As a second edge 42, which is the trail edge, passes beyond the refeed guide 28, the refeed guide rotates under the force of gravity back to its first position 150 (see FIG. 13). An edge sensor 44 detects the passing of the first edge 40, then the passing of the second edge 42, as the media sheet 38 is fed along the media path during first side printing. The printer controller 80 receives the edge sensor 44 indications, and determines the media sheet length.

Once the second edge 40 is detected, the metering rollers 30 meter the media sheet 38 a predetermined amount more to complete printing to the first side. The metering rollers 30 then stop the movement of the media sheet 38, while the media sheet 38 in the vicinity of the second edge 40 remains pinched between the metering rollers 30 and the pinch rollers 32 (see FIG. 13). The metering rollers pause rotation for a prescribed time delay for at least partial drying of the media sheet.

The metering rollers 30 then reverse direction to rotate in a second direction 47 and move the media sheet 38 back toward the refeed guide 128. The refeed guide 128 blocks the original media path and guides the media sheet 38 down along a second surface 133 (labelled in FIG. 11) onto a first surface 165 (labelled in FIG. 11) of the middle guide 129. As the media sheet 38 is fed back, the second edge 42 is now the lead edge and the first edge 40 is now the trail edge. As the lead second edge 42 progresses along the middle guide 129, the edge 42 encounters the second end 162 of the wrap around fingers 137 pushing the wrap around fingers 137 from the first position 155 to the second position 157. Thus, the media sheet pushes the second end 162 of the wrap around fingers 137 out of the media path along the middle guide 129. The media sheet 38 then encounters the repick guide 136. The metering rollers 30 have now fed the media sheet 38 under the refeed guide 128, along an upper first surface 165 of the middle guide 129 and onto the repick guide 136. The media sheet second edge 42 then is picked and fed onto the pick and feed rollers 22, 23 from the repick guide 136. As the media sheet 38 encounters and moves along the repick guide 136, the media sheet 38 moves the repick guide 136 from the first position 154 to the second position 156 (see FIGS. 11 and 14). It is the force of the pick and feed rollers moving the media sheet that forces the repick guide 136 to move down into its second position 156. During the first side printing and through the repicking during the refeed process, the pick and feed rollers 22, 23 have been rotating in the first direction 39 and continue to do so feeding the media sheet around the rollers 22, 23 toward the upper feed guide 26.

The media sheet 38 is fed with the second edge 42 as the lead edge around the pick and feed rollers 22, 23 and along the upper feed guide 26. The wrap around fingers 137 at this time are in the second position 157 (see FIGS. 14 and 15) blocking the media path along the upper feed guide 126 toward the metering rollers 30. Thus, the wrap around fingers 137 guide the lead second edge 42 of the media sheet 38 to continue along a second surface 163 (labelled in FIG. 11) of the wrap around fingers 137 and around the pick and feed rollers 22, 23. As the pick and feed rollers 22, 23 continue rotating in the first direction 39 the media sheet 38 overlaps itself (see FIG. 15). The amount of overlap depends upon the length of the media sheet and the circumference of the pick and feed rollers 22, 23. Wrapping around of the media sheet 38 continues until the trail first edge 40 clears the middle guide 129. Because the print controller 80 has determined the length of the media sheet, and because the path length from the metering rollers 30 back to the pick and feed rollers 22, 23 is known, and the circumference of the pick and feed rollers 22, 23 are known, the print controller is able to determine when the media sheet has cleared the middle guide 129 as the media sheet advances on the pick and feed rollers 22, 23. Thus, the print controller 80 is able to determine when to change the direction of the pick and feed rollers 22, 23.

Once the trail first edge 40 clears the second end 162 of the wrap around fingers (i.e., end toward middle guide 129), the media sheet 38 no longer biases the second end 162 of the wrap around fingers 137 out of the media path at the middle guide 129. Thus, the wrap around fingers 137 are biased back toward the first position 155. At such time the media sheet 38, however is wrapped around the pick and feed rollers 22, 23 preventing the wrap around fingers from returning all the way to the first position 155. Contact between the first end 160 of the wrap around fingers and the media sheet 38 does not prevent the continued wrapping of the media sheet around the pick and feed rollers 22, 23.

Once the media sheet trail first edge 40 clears the middle guide 129, but remains on the repick guide 136, the pick and feed rollers 22, 23 reverse to a direction 141 causing the media sheet 38 to unwrap. The reverse rotation of the pick and feed rollers 22, 23 moves the media sheet first edge 40 back along the repick guide 136, under the middle guide 129 at a surface 169 of the middle guide 129 into the input tray 12. The media sheet thus unwraps into the input tray 12. Once the unwrapping completes, in effect the media sheet 38 has been flipped from when it was first picked from the input tray to print to the first side. During the unwrapping, once the media sheet second edge 42 clears the wrap around fingers 137, the wrap around fingers 137 return fully to the first position 155.

Based upon another signal from the media edge sensor 44 at the second leading edge 42, the print controller 80 is able to determine when to stop unwrapping the media sheet into the input tray 12. When unwrapping completes, the pick and feed rollers 22, 23 change direction again to the original direction 39. The pick and feed rollers 22, 23 now refeed the media sheet 38 along the first path toward the metering rollers 30 with the second side exposed for printing. During such refeeding, the wrap around fingers 137 are back in the biased first position 155. Thus, the media sheet 38 is fed from the pick and feed rollers 22, 23 between the upper feed guide 126 and the wrap around fingers 137 toward the refeed guide 128. The media sheet continues onward pushing the refeed guide 128 from the first position 150 into the second position 152. The media sheet is fed along refeed guide first surface 131 to the metering rollers 30. The metering rollers 30 meter the media sheet 38 through the print zone 18 and into the output region 20 of the printer 100 to complete the duplex print cycle. As the trail first edge 40 clears the refeed guide 128 the refeed guide returns to the first position 150.

Figure 12:
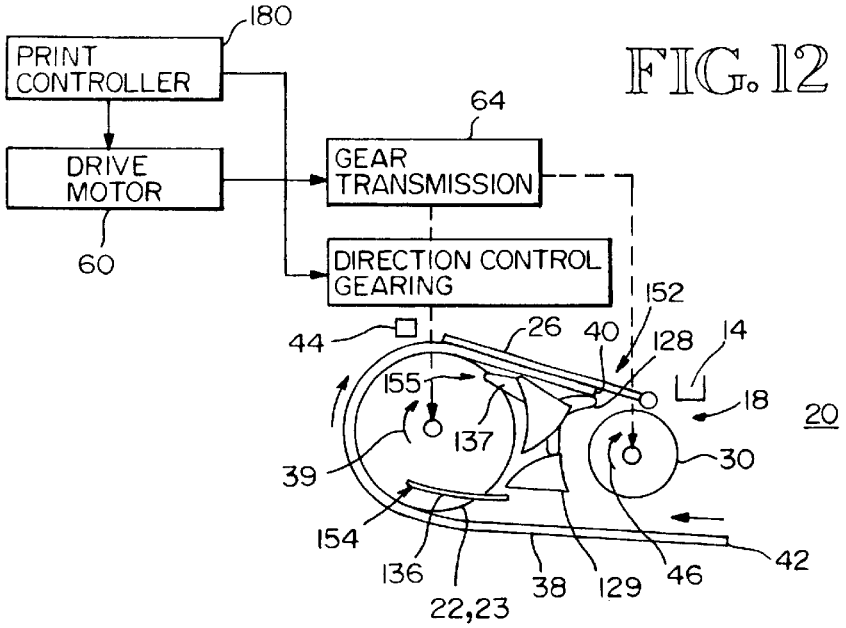
FIG. 12 is a diagram of print drive components and media handling components for the printer of FIG. 10 during first side printing.
Figure 13:
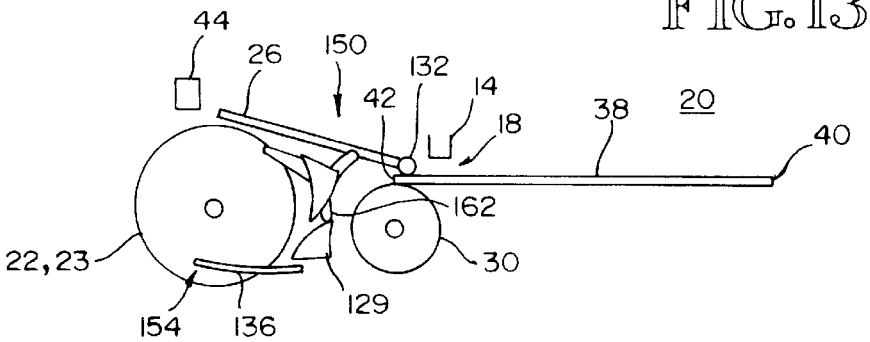
FIG. 13 is a diagram of the media handling components of FIG. 10 at a time between first side printing and second side printing.
Figure 14:
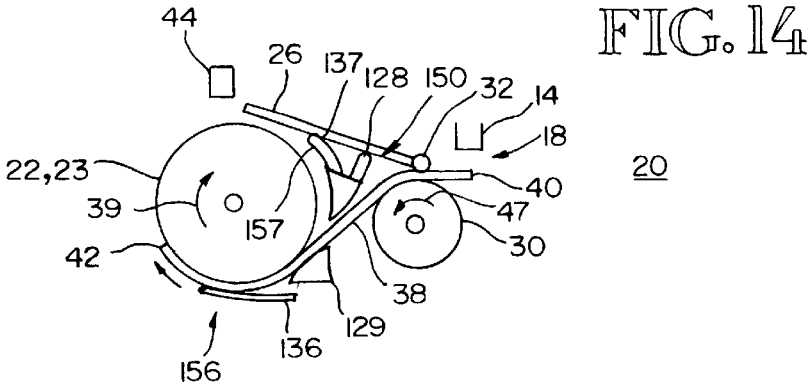
FIG. 14 is a diagram of the media handling components of FIG. 13 during refeeding of the media sheet onto the pick and feed rollers.
Figure 15:
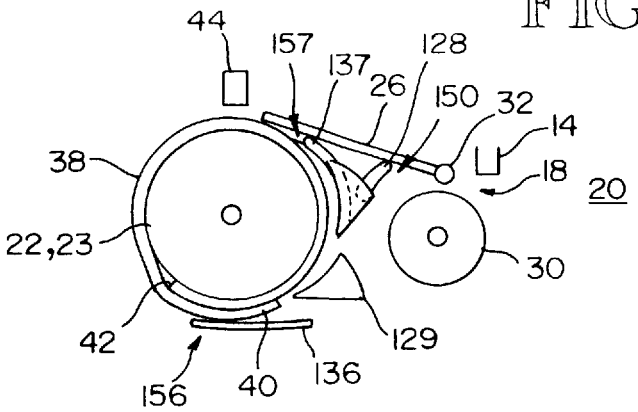
FIG. 15 is a diagram of the media handling components of FIG. 13 showing the media sheet wrapping around the pick and feed rollers and showing the media sheet overlapping its lead edge.
Figure 16:
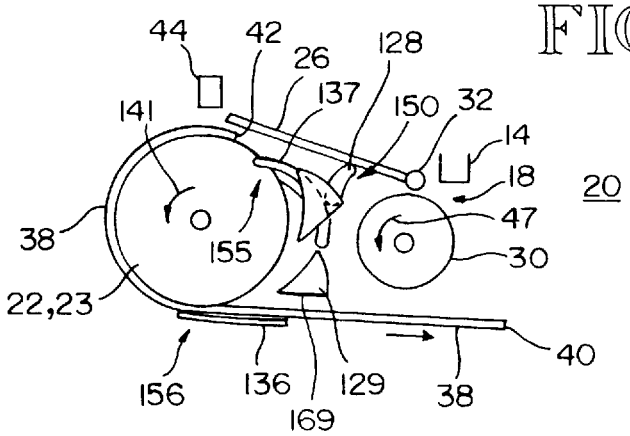
FIG. 16 is a diagram of the media handling components of FIG. 13 showing the media sheet being unwrapped from the pick and feed rollers into the input tray.
Figure 17:
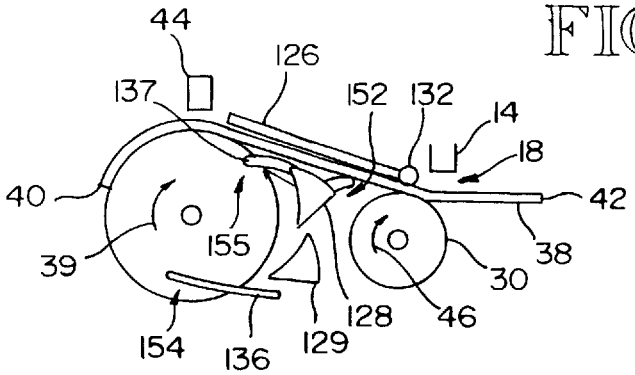
FIG. 17 is a diagram of the media handling components of FIG. 13 showing the media sheet fed through the print zone during second side printing.

Referring to FIG. 12 the drive motor 60 is shown with gear transmission 64 for driving the metering rollers 30 and the pick and feed rollers 22, 23. A gear pair 66 and a gear 62 for controlling the relative directions of the metering rollers 30 compared to the pick and feed rollers 22, 23 also are included. During first side printing, the drive motor drives the metering rollers 30 and pick and feed rollers 22, 23 in a first direction via the gear transmission 64 through the gear 62. The drive motor 60 stops after the first side is printed to allow time for the first side to dry. While the first side is drying the trail edge of the media sheet is pinched between the metering rollers 30 and the pinch rollers 32. To move the media sheet back along the second path to be repicked by the pick roller 22, the drive motor 60 starts in reverse, the direction control gear pair 66 is engaged and the gear 62 is disengaged to rotate the metering rollers 30 in an opposite direction from the pick and feed rollers 22, 23. Thus, the pick and feed rollers 22, 23 rotate in their first direction 39, and the metering rollers 30 rotate in their second direction 47. The media sheet then is wrapped around the pick and feed rollers 22, 23 until the trail first edge 40 clears the middle guide 129. The print controller 80 having derived the length of the media sheet and knowing the relative path distances within the media handling system is able to determine when the media sheet trail first edge has cleared the middle guide 129. When the middle guide 129 is cleared, the print controller 80 triggers drive motor 60 to reverse directions causing the pick and feed rollers to rotate in a reverse direction 141. The media sheet then unwraps. After a time determined based upon the media sheet length the unwrapping is complete and the print controller 80 causes the drive motor 60 to return to its original forward direction. Thus, the pick and feed rollers 22, 23 change direction again to rotate in the original direction 39.

In this embodiment the metering rollers 30 always rotate in the same direction as the motor 60. The relative direction of the pick and feed rollers 30 is determined by engaging or disengaging the gear pair 66. In such embodiment the media sheet is fed back along the second path from the metering rollers 30 to the pick and feed rollers 22, 23 by reversing the motor 60 direction, engaging the gear pair 66 and disengaging the gear 62. Thus, the metering rollers rotate in the reverse second direction 47, while the pick and feed rollers rotate in the original first direction 39. To unwrap the media sheet from the pick and feed rollers 22, 23 the gear pair 66 is disengaged and the gear 62 is engaged causing the pick and feed rollers to reverse to a second direction 141. The metering roller direction is insignificant at such time, but is the second direction 47. To refeed the media sheet for second side printing after being unwrapped, the motor 60 direction returns to the forward direction. Thus, the pick and feed rollers 22, 23 return to rotating in the direction 39 and the metering rollers 30 return to rotating in the direction 46.

In an alternative embodiment the pick and feed rollers 22, 23 always rotate in the same direction as the drive motor 60. The metering rollers 30 rotate in the same or the opposite direction depending upon whether the gear pair 66 is engaged (and correspondingly, the gear 62 disengaged). The direction control gear pair 66 is disengaged and the gear 62 is engaged at any time after the media sheet clears the metering rollers 30 after being fed along the middle guide 129, and before the media sheet is refed from the pick and feed rollers 22, 23 to the metering rollers 30 for second side printing.

Referring to FIGS. 10, 11, 19 and 20, a refeed guide mount 134 suspends the refeed guides 128 and the wrap around finger guide members 137 under the upper guide 26, between the pick/feed rollers 22, 23 and the metered rollers 30. The mount 134 is coupled to side chassis walls of the printer 10. Note that the mount 134 surfaces are shown in less detail in FIG. 20 than in FIG. 19.

Referring to FIGS. 10 and 18, the upper feed guide 26 is shown as an elongated guide mechanism over the pick and feed rollers 22, 23 between the metering rollers 30 and the pick and feed rollers 22, 23. The upper feed guide 26 includes openings 49. In one embodiment the wrap around fingers 137 protrude through the openings 49 (see FIG. 18), respectively, while the wrap around fingers are in their second position 157. In one embodiment, the refeed guides 128 protrude into openings 49 (see FIG. 18), respectively, while in their second positions 152. The edge sensor 44 detects a media sheet edge through an opening 49 of the upper feed guide 26.

Alternative Media Handling System and Method for Duplex Printing

Figure 21:
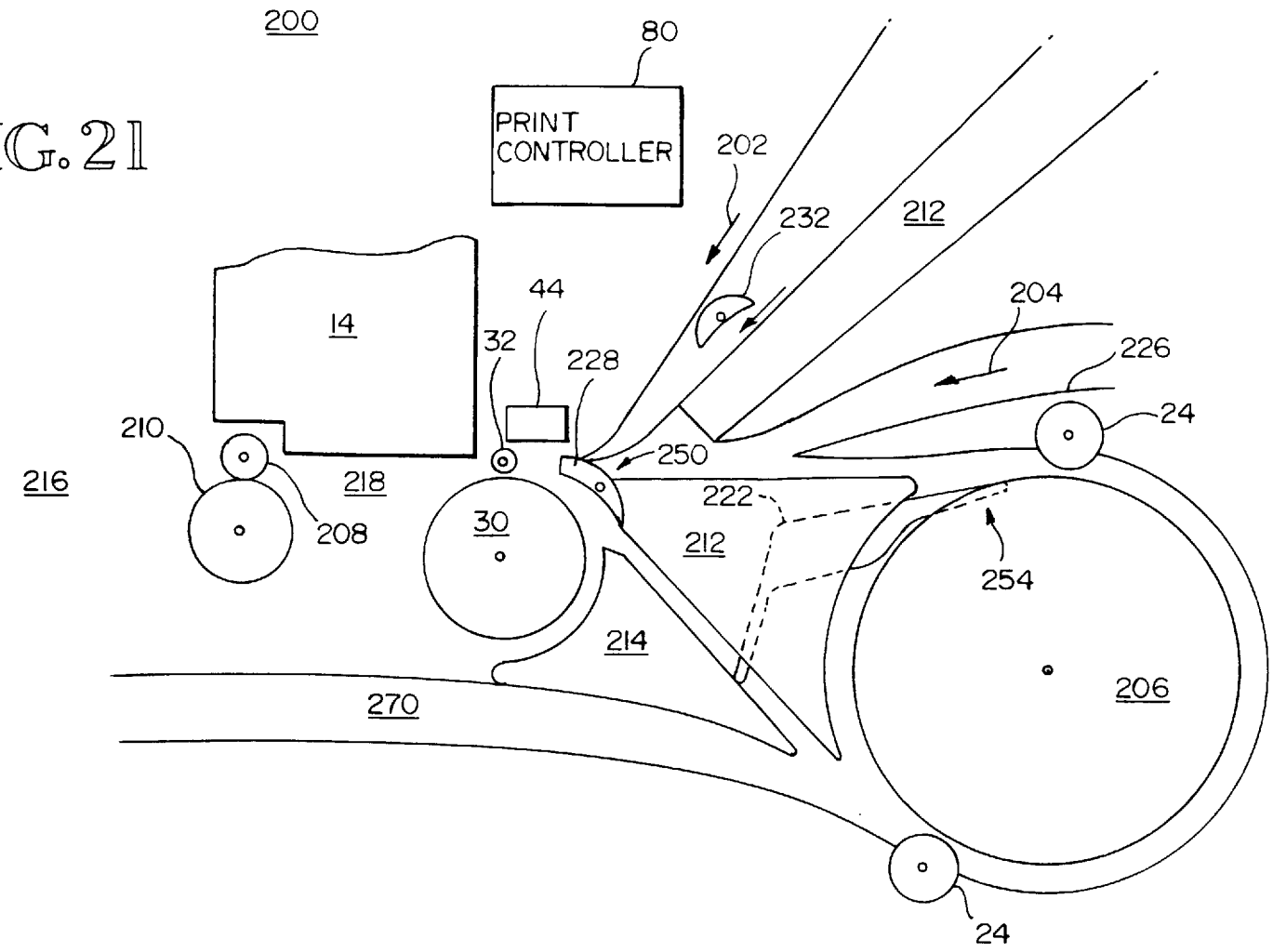
FIG. 21 is a planar side view of a portion of an inkjet printer according to another embodiment of this invention.

FIG. 21 shows an inkjet printer 200 according to another alternative embodiment of this invention. The printer 200 includes a media handling system for routing a media sheet to print first to one face of the media sheet, then to an opposite face of the media sheet. Like parts of printer 200 and printers 10 or 100 are given the same part numbers. The printer 200 includes an input tray 212, the media handling system, an inkjet pen 14, and an output region 216. A media sheet is picked from either the input tray 212 or from alternative feed paths 202, 204. A media sheet is fed along a media path by the media handling system to a print zone 218 where a first face of the media sheet receives print. During such feed and print operations a first edge of the media sheet serves as a lead edge and a second edge serves as a trail edge. The media sheet continues along the media path into an output region 216. For single sided printing (i.e., simplex printing), the media sheet is released into the output region 216. For two sided printing (also referred to as duplex printing), the media sheet is not released. Instead the media sheet is moved back in the media handling system with the second edge now serving as the lead edge and the first edge now the trail edge. The media sheet eventually advances again into the print zone 218 with the second face exposed to receive print. The media sheet then is fed into the output region 216 to complete the duplex printing process.

Figure 22:
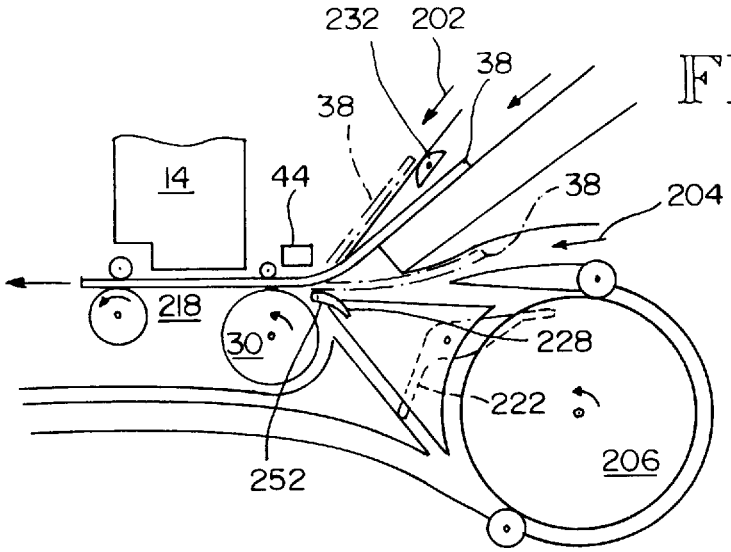
FIG. 22 is a diagram of the media handling components for the printer of FIG. 21 showing a feed path for first side printing.
Figure 23:
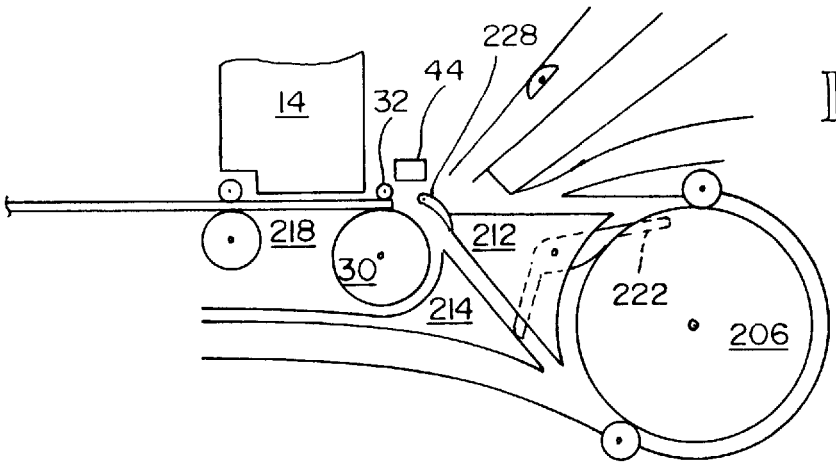
FIG. 23 is a diagram of the media handling components of FIG. 21 at a time between first side printing and second side printing.

Referring to FIGS. 22–25 and 27, the media handling system of printer 200 is shown for various stages of a duplex printing cycle. The media handling system includes a sensor 44, refeed guides 228, metering rollers 30, metering pinch rollers 32, a star wheel 208, kicker roller 210, inversion rollers 206, idler rollers 24, an upper guide 226, inner guide 212, middle guide 214 and wrap around finger guide mechanisms 222 (also referred to as wrap around fingers 222 or fingers 222). The refeed guides 228 are movable between a first position and a second position and are biased by gravity into the first position. FIG. 210 shows a refeed guide 228 in the first position 250. FIG. 22 shows the refeed guide 228 in the second position 252. The inner guides 212 and middle guides 214 are stationary and located between the inversion rollers 206 and the metering rollers 30.

Figure 24:
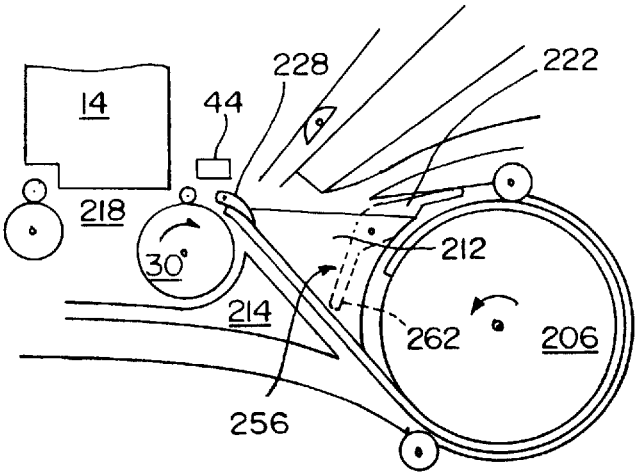
FIG. 24 is a diagram of the media handling components of FIG. 21 showing the media sheet wrapping around an inversion roller.

The wrap around finger members 222 are movable between a first position and a second position. Each wrap around finger 222 is gravity biased into the first position 254 as shown in FIG. 21. FIG. 24 shows a wrap around finger 222 in the second position 256.

A duplex printing method embodiment for the printer 200 is described below with regard to FIGS. 22–27. A media sheet 38 is picked from the input tray 212 by a pick device 232. Alternatively a sheet 38 is fed along a single sheet feed path 202 or another single sheet feed path 204. The media sheet 38 moves over the refeed guide 228, between the metering roller 30 and pinch roller 32. As the media sheet moves over the refeed guide 228, the media sheet moves the refeed guide 228 into its second position 252. The metering rollers 30 rotate in a first direction 39 feeding the media sheet into the print zone 218 toward the starwheel and kicker roller and the output region 216. The inkjet pen 14 prints to the media sheet first side. The wrap around fingers 222 are in the first position during this first side printing. A first edge of the media sheet 38 serves as the lead edge as the media sheet 38 is fed along the media path toward the print zone 218. As a second edge which is the trail edge, passes beyond the refeed guide 228, the refeed guide rotates under the force of gravity back to its first position 250. An edge sensor 44 detects the passing of the lead edge, then the passing of the trail edge. A printer controller 80 receives the edge sensor 44 indications, and determines the media sheet length.

Once the trail edge 40 is detected, the metering rollers 30 meter the media sheet 38 a predetermined amount more to complete printing to the first side. The metering rollers 30 then stop the movement of the media sheet 38, while the media sheet 38 in the vicinity of the trail edge remains pinched between the metering rollers 30 and the pinch rollers 32 (see FIG. 23).

The metering rollers 30 then reverse direction to rotate in a second direction and move the media sheet 38 back toward the refeed guide 228. The refeed guide 228 blocks the original media path and guides the media sheet 38 between the inner feed guide 212 and the middle guide 214. As the media sheet 38 is fed back, the second edge is now the lead edge and the first edge is now the trail edge. As the lead second edge progresses along the middle guide 214, the lead second edge encounters an end 262 of the wrap around fingers 222 pushing the wrap around fingers 222 from the first position 254 to the second position 256. Thus, the media sheet pushes the second end 262 of the wrap around fingers 222 out of the media path along the middle guide 214. The media sheet 38 then is fed onto the inversion roller 206.

The media sheet 38 is fed with the second edge 42 as the lead edge around the inversion rollers 206. The wrap around fingers 222 at this time are in the second position 256 (see FIG. 24) blocking the media path along the upper feed guide 226. Thus, the wrap around fingers 222 guide the lead second edge of the media sheet 38 to continue around the inversion rollers 206. As the inversion rollers 206 continue rotating the media sheet 38 overlaps itself. The amount of overlap depends upon the length of the media sheet and the circumference of the inversion rollers 206. Wrapping around of the media sheet 38 continues until the trail first edge clears the wrap around finger end 262. Because the print controller 80 has determined the length of the media sheet, and because the path length from the metering rollers 30 back to the inversion rollers 206 and the circumference of the inversion rollers 206 are known, the print controller is able to determine when the media sheet has cleared the wrap around fingers 222 and the middle guide 214. Thus, the print controller 80 is able to determine when to change the direction of the inversion rollers 206.

Figure 25:
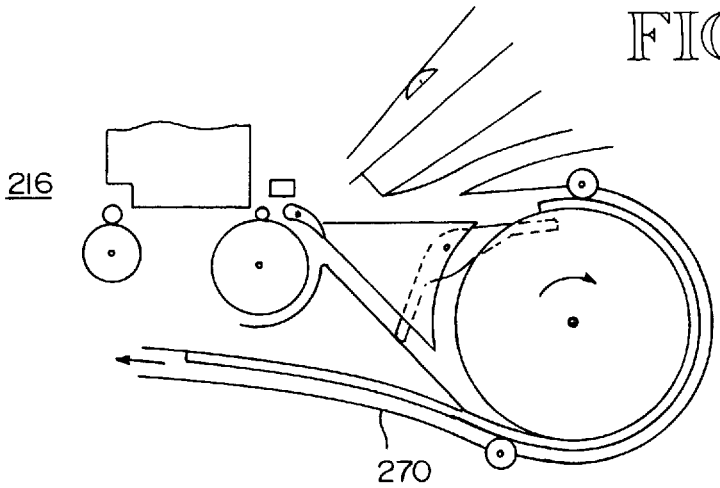
FIG. 25 is a diagram of the media handling components of FIG. 21 showing the media sheet being unwrapped into a chute.
Figure 26:
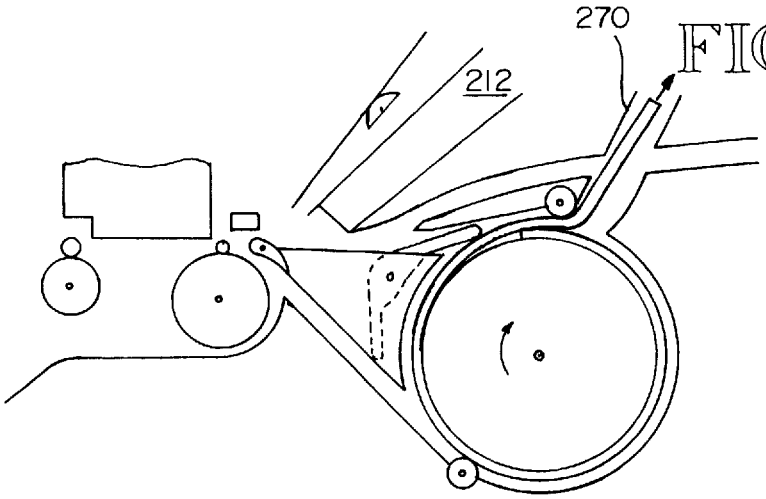
FIG. 26 is a diagram of the media handling components showing the media sheet being unwrapped into a chute according to another embodiment of this invention.
Figure 27:
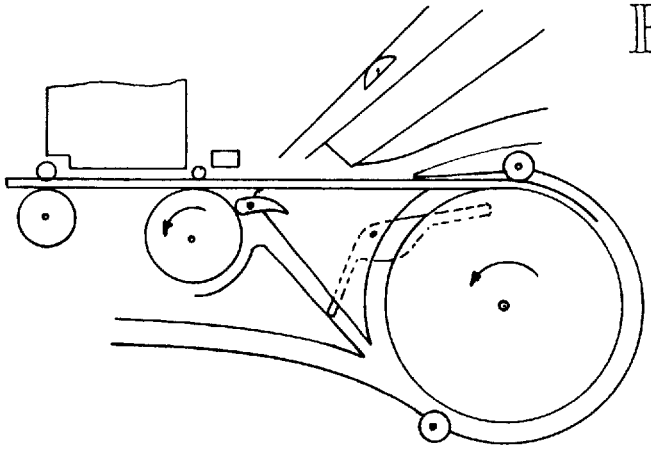
FIG. 27 is a diagram of the media handling components of FIG. 21 showing the media sheet fed through the print zone during second side printing.

Once the media sheet trail first edge clears the middle guide 214, the inversion rollers 206 reverse direction causing the media sheet 38 to unwrap into an unwrapping chute 270 (see FIG. 25). In one embodiment the chute 270 is toward the output region 216. In an alternative embodiment shown in FIG. 26, the unwrap chute is located above the inversion roller 206 behind the input tray 212. Once the unwrapping completes, in effect the media sheet 38 has been flipped from when it was first picked from the input tray to print to the first side. During the unwrapping, once the media sheet second edge clears the wrap around fingers 222 the wrap around fingers 222 return fully to the first position 254.

Based upon determined sheet length, roller circumference and roller step size increment, the print controller 80 is able to determine when to stop unwrapping the media sheet into the unwrapping chute 270. When unwrapping completes, the inversion rollers 206 change direction again. The inversion rollers 206 now refeed the media sheet 38 toward the metering rollers 30 with the second side exposed for printing. During such refeeding, the wrap around fingers 222 are back in the first position 254. The metering rollers 30 meter the media sheet 38 through the print zone 218 and into the output region 216 to complete the duplex print cycle.

The mechanisms for controlling the directions of the inversion rollers 206 and metering rollers 30 are the same as described for the prior embodiments.

Figure 28:
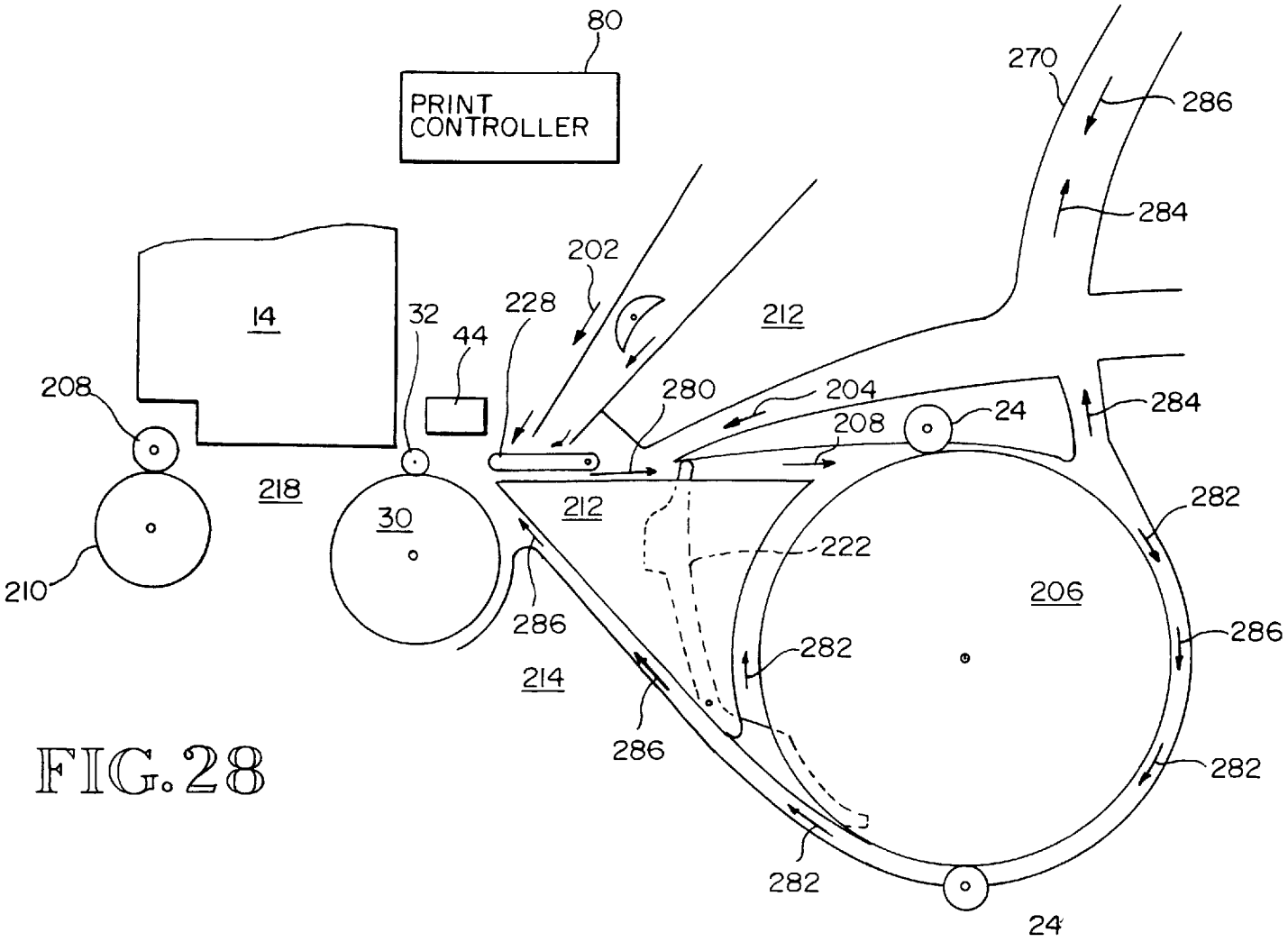
FIG. 28 is a planar side view of a portion of an inkjet printer according to another embodiment of this invention.

FIG. 28 shows another embodiment of the printer in which like parts are given like numbers. The steps for printing to a first side of a media sheet are the same as described above with respect to the embodiment of FIG. 21. With regard to second side printing, the path taken for inverting the media sheet differs. After the first side printing is complete (and after the drying time elapses), a media sheet is fed back from the metering rollers 30 toward the inversion rollers 206 along media path 280. The media sheet passes between the refeed guide 228 and the inner guide 212, pushing the wrap around fingers 222 out of the path. The inversion rollers 206 wrap the media sheet around the roller as depicted by arrows 282. Once the trail edge of the media sheet clears the upper guide 226, the inversion roller changes direction to unwrap the media sheet into the chute 270 along direction 284. Once unwrapping is complete the inversion rollers 206 again change direction, moving the media sheet along a path indicated by arrows 286. The media sheet is fed from the inversion rollers 206 between the inner guide 212 and middle guide 214 to the metering rollers 30 and pinch rollers 32. The metering rollers 30 feed the media sheet through the print zone 218 toward the output region 216. The pen 214 prints to the media sheet second side to complete the duplex printing cycle.

Meritorious and Advantageous Effects

One advantage of the invention is that the wrap around finger members allow the media sheet to be wrapped around the first roller so as to enable duplex printing to media sheets longer than a path length from the second roller back around the first roller and back to the second roller. Another advantage is that the media sheet is not released between the time the first side is printed and the time the media sheet starts to be re-fed back toward the upper feed guide and first roller. Another advantage is that a drying time is included for wet ink printing to allow time for the first side of the media sheet to dry before printing to the second side of the media sheet. Another advantage of the invention is that the gravity biasing of the refeed guide enables the refeed guide to provide directional control of the media sheet without interfering with single-side printing operations. Another advantage is that the wrap around finger members are activated by the media sheet moving through the second path. Another advantage of the invention is that the repick guide is located so as not interfere with the original pick process. Another advantage of the invention is that duplex printing is achieved with few parts at relatively low cost. Another advantage of the invention is that duplex printing is achieved for different paper widths and paper weights.

Although a preferred embodiment of the invention has been illustrated and described, various alternatives, modifications and equivalents may be used. Therefore, the foregoing description should not be taken as limiting the scope of the inventions which are defined by the appended claims.

What is claimed is:

1. A media sheet handling system for enabling printing to a first side and a second side of a media sheet, comprising:

a first roller which feeds the media sheet along a first path toward a print zone, the media sheet having a first edge and a second edge opposite the first edge;

a second roller located along the first path between the first roller and the print zone, the second roller receiving a lead edge of the media sheet as the media sheet progresses along the first path from the first roller to the second roller;

wherein during printing to the first side of the media sheet during a duplex printing operation, the second roller rotates in a first direction to advance the media sheet into the print zone, the second roller discontinuing rotation in the first direction after printing to the first side is complete and while a portion of the media sheet remains in contact with the second roller, and wherein the first edge of the media sheet serves as the lead edge during printing to the first side;

a refeed guide located along the first path between the first roller and the second roller, the refeed guide movable between a first position and a second position, the refeed guide biased toward the first position, wherein action of the media sheet passing over the refeed guide along the first path moves the refeed guide into the second position;

a first signal triggering the second roller to change direction to rotate in a second direction opposite the first direction while the portion of the media sheet remains in contact with the second roller, wherein the second roller moves the media sheet back toward the refeed guide while rotating in the second direction, the second edge of the media sheet being the lead edge during movement of the media sheet back toward the refeed guide, and wherein the refeed guide is positioned in the first position blocking the first path when the second edge serving as the lead edge contacts the refeed guide during the movement of the media sheet back toward the refeed guide, the refeed guide directing the media sheet along a second path; and wherein the media sheet is re-fed around the first roller along the first path to the second roller and through the print zone to receive print onto the media sheet second side.

2. The system of claim 1, wherein the refeed guide directs the media sheet along the second path toward the first roller.

3. The system of claim 1, further comprising an output region, wherein at least a portion of the media sheet is fed through the print zone and into the output region during printing to the media sheet first side and during printing to the media sheet second side; and wherein the media sheet is released into the output region after printing to the media sheet second side.

4. The system of claim 3, wherein the print zone is adjacent to the second roller between the second roller and the output region.

5. The system of claim 1, further comprising a repick guide along the second path in the vicinity of the first roller, the repick guide moving between a repick guide first position and a repick guide second position, the repick guide biased to the repick guide first position, wherein the refeed guide directs the lead second edge of the media sheet onto the repick guide while the second roller rotates in the second direction, and wherein the repick guide directs the lead second edge to the first roller to enable the first roller to pick the media sheet at the lead second edge, and wherein the repick guide moves into the repick guide second position between a time that the lead second edge of the media sheet moves onto the repick guide and a time where the lead second edge advances beyond the repick guide along the first roller.

6. The system of claim 5, wherein the repick guide moves into the second position during the picking of the media sheet lead second edge from the repick guide.

7. The system of claim 1, further comprising a middle guide positioned along the second path between the first roller and the second roller, wherein the refeed guide directs the lead second edge of the media sheet toward the middle guide while the second roller rotates in the second direction.

8. The system of claim 7, further comprising a repick guide along the second path in the vicinity of the first roller, the repick guide moving between a repick guide first position and a repick guide second position, the repick guide biased into the repick guide first position, wherein the middle guide directs the lead second edge of the media sheet onto the repick guide while the second roller rotates in the second direction, and wherein the repick guide directs the lead second edge to the first roller to enable the first roller to pick the media sheet at the lead second edge, and wherein the repick guide moves into the repick guide second position between a time that the lead second edge of the media sheet moves onto the repick guide and a time where the lead second edge advances beyond the repick guide along the first roller.

9. The system of claim 7, further comprising a finger guide member having a first portion and a second portion, the finger guide member having a first surface and a second surface at the first portion, the finger guide member movable between a finger guide first position and a finger guide second position and being biased toward the finger guide first position, the finger guide member located between the first roller and the second roller, wherein the first portion extends toward the first path and the second portion extends toward the middle guide and second path, and wherein while the finger guide member is in the finger guide first position the second portion extends into the second path, and while the finger guide member is in the finger guide second position the first portion extends into and blocks the first path, and wherein while the second portion extends into the second path contact with the media sheet moving along the second path pushes the finger guide member at the second portion out of the second path and from the finger guide first position into the finger guide second position.

10. The system of claim 9, wherein the first roller rotates in a first direction during feeding of the media sheet from the first roller to the second roller along the first path, and wherein the middle guide has a first surface along the second path and a second surface out of the second path, and further comprising a second signal triggering the first roller to reverse direction from the first roller's first direction to a second direction, wherein the lead second edge of the media sheet is directed to wrap around the first roller when encountering the finger guide member in the finger guide member second position, and wherein the first roller changes direction to the second direction after a trail first edge of the media sheet clears the middle guide causing the media sheet to unwrap back toward the middle guide, the media sheet passing adjacent to the second surface of the middle guide while unwrapping.

11. The system of claim 10, further comprising an input region adjacent to the first roller and middle guide second surface, and wherein the media sheet unwraps into the input region while the first roller rotates in the first roller's second direction, and wherein the input region comprises an input tray from which the media sheet is originally picked for printing to the first side of the media sheet.

12. The system of claim 11, further comprising an output region, wherein at least a portion of the media sheet is fed through the print zone and into the output region during printing to the media sheet first side and during printing to the media sheet second side; and wherein the media sheet is released into the output region after printing to the media sheet second side.

13. The system of claim 12, wherein the print zone is adjacent to the second roller between the second roller and the output region.

14. A media sheet handling system for enabling printing to a first side and a second side of a media sheet, comprising:

a first roller which feeds the media sheet along a first path toward a print zone, the media sheet having a first edge and a second edge opposite the first edge;

a second roller located along the first path between the first roller and the print zone, the second roller receiving a lead edge of the media sheet as the media sheet progresses along the first path from the first roller to the second roller;

a media sheet edge sensor which generates a first signal when a lead edge of the media sheet is detected and which generates a second signal when a trail edge of the media sheet is detected;

wherein during printing to the first side of the media sheet during a duplex printing operation, the second roller rotates in a first direction to advance the media sheet into the print zone, the second roller discontinuing rotation in the first direction after printing to the first side is complete and while a portion of the media sheet remains in contact with the second roller, and wherein the first edge of the media sheet serves as the lead edge during printing to the first side;

a refeed guide located along the first path between the first roller and the second roller, the refeed guide movable between a first position and a second position, the refeed guide biased toward the first position, wherein action of the media sheet passing over the refeed guide along the first path moves the refeed guide into the second position;

a controller which receives the first signal and second signal and derives a trigger signal based upon an interval between receiving the first signal and second signal, the trigger signal triggering the second roller to change direction to rotate in a second direction opposite the first direction while the portion of the media sheet remains in contact with the second roller, wherein the second roller moves the media sheet back toward the refeed guide while rotating in the second direction, the second edge of the media sheet being the lead edge during movement of the media sheet back toward the refeed guide, and wherein the refeed guide is positioned in the first position blocking the first path when the second edge serving as the lead edge contacts the refeed guide during the movement of the media sheet back toward the refeed guide, the refeed guide directing the media sheet along a second path toward the first roller; and wherein the media sheet is re-fed around the first roller along the first path to the second roller and through the print zone to receive print onto the media sheet second side.

15. The system of claim 14, wherein the trigger signal is a first trigger signal, and wherein before the media sheet is re-fed to the second roller, the media sheet is wrapped around the first roller, and the media sheet is unwrapped from the first roller, wherein the sensor senses the second edge of the media sheet as the lead edge before the media sheet wraps around the first roller, the sensor generating in response a third signal, and wherein the controller based upon the third signal and the increment between receiving the first signal and second signal generates a second trigger signal when the first edge of the media sheet as the trail edge is in the desired position and generates a third trigger signal after the second trigger signal, the second trigger signal reversing the direction of the first roller to unwrap the media sheet, the third trigger signal changing the direction of the first roller to the first roller's original direction, the first roller re-feeding the media sheet with the second edge as the lead edge along the first media path to the second roller and through the print zone for second side printing.

16. The system of claim 15, further comprising a middle guide positioned along the second path between the first roller and the second roller, wherein the refeed guide directs the lead second edge of the media sheet toward the middle guide while the second roller rotates in the second direction.

17. The system of claim 16, further comprising a repick guide along the second path in the vicinity of the first roller, the repick guide moving between a repick guide first position and a repick guide second position, the repick guide biased into the repick guide first position, wherein the middle guide directs the lead second edge of the media sheet onto the repick guide while the second roller rotates in the second direction, and wherein the repick guide directs the lead second edge to the first roller to enable the first roller to pick the media sheet at the lead second edge, and wherein the repick guide move s into the repick guide second position between a time that the lead second edge of the media sheet moves onto the repick guide and a time where the lead second edge advances beyond the repick guide along the first roller.

18. The system of claim 16, further comprising a finger guide member having a first portion and a second portion, the finger guide member having a first surface and a second surface at the first portion, the finger guide member movable between a finger guide first position and a finger guide second position and being biased toward the finger guide first position, the finger guide member located between the first roller and the second roller, wherein the first portion extends toward the first path and the second portion extends toward the middle guide and second path, and wherein while the finger guide member is in the finger guide first position the second portion extends into the second path, and while the finger guide member is in the finger guide second position the first portion extends into and blocks the first path, and wherein while the second portion extends into the second path contact with the media sheet moving along the second path pushes the finger guide member at the second portion out of the second path and from the finger guide first position into the finger guide second position.

19. A media sheet handling method for printing to two sides of a media sheet, comprising the steps of:

feeding the media sheet with a first roller along a first path onto a second roller;

rotating the second roller in a first direction to advance at least a portion of the media sheet through a print zone, wherein a first edge of the media sheet is a lead edge during said feeding and rotating steps;

printing to a first side of the media sheet within the print zone during the rotating step;

after the step of printing to the first side, discontinuing rotation of the second roller in the first direction while a portion of the media sheet remains in contact with the second roller;

moving a refeed guide into the first path to block the first path in a region between the first roller and the second roller;

rotating the second roller in a second direction opposite the first direction to move the media sheet back toward the refeed guide, wherein the refeed guide directs the media sheet along a second path to be repicked by the first roller;

refeeding the media sheet from the first roller to the second roller and through the print zone, wherein a second edge opposite the first edge of the media sheet is the lead edge during said refeeding step;

after the media sheet clears the second roller during said step of rotating the second roller in the second direction, reversing the direction of the second roller to rotate in the first direction, wherein said reversing direction of the second roller to the first direction occurs before the media sheet second edge is fed onto the second roller from the first roller; and printing to a second side of the media sheet within the print zone during the refeeding step.

20. The method of claim 19, wherein the step of printing to the first side of the media sheet comprises wet ink printing; and wherein after the step of discontinuing rotation of the second roller in the first direction and before the step of rotating the second roller in a second direction, there is a prescribed time delay to allow drying of the media sheet.

21. The method of claim 20, wherein at least a portion of the media sheet is fed through the print zone and into an output region during printing to the media sheet first side and during printing to the media sheet second side; wherein the media sheet resides in the output region for the prescribed drying time delay; and wherein the media sheet is released into the output region after printing to the media sheet second side.

22. The method of claim 19, further comprising, during the step of rotating the second roller in a second direction, the steps of:

capturing the second edge of the media sheet with the first roller; and wrapping the media sheet around the first roller at least until the media sheet clears the second roller; and further comprising, prior to the step of refeeding, the step of reversing the direction of the first roller to unwrap the media sheet without the media sheet re-encountering the second roller.

23. The method of claim 22, further comprising, prior to the step of feeding the media sheet, the step of picking the media sheet from an input region, and wherein the step of reversing the direction of the first roller comprises reversing the direction of the first roller to unwrap the media sheet at least partially into the input region.

24. The method of claim 19, further comprising, during the step of rotating the second roller in a second direction, the steps of:

capturing the second edge of the media sheet with the first roller; and retracting the media sheet from the second roller with the first roller; and wherein, during the step of feeding, the first roller rotates in an original direction; and further comprising, prior to the step of refeeding, the step of reversing the direction of the first roller from the original direction to a reverse direction to move the media sheet into a position for refeeding, wherein the media sheet is moved during the step of reversing the direction of the first roller without encountering the second roller; and wherein the step of refeeding comprises reversing the direction of the first roller from the reverse direction back to the original direction.

25. The method of claim 19, wherein during the feeding of the media sheet along the first path onto the second roller, the media sheet encounters the refeed guide at a position between the first roller and the second roller, wherein the refeed guide is movable between a first position and a second position and is biased into the first position; wherein during the step of feeding, the lead edge of the media sheet pushes the refeed guide into the second position; and wherein the step of moving the refeed guide into the first path to block the first path occurs after the media sheet clears the refeed guide and the refeed guide is biased back into the first position.

26. The method of claim 19, wherein a finger guide member having a first portion and a second portion is positioned between the first roller and the second roller, the finger guide member movable between a finger guide member first position and a finger guide member second position and being biased to the finger guide member first position, wherein the first portion extends toward the first path and the second portion extends toward the second path, and wherein while the finger guide member is in the finger guide first position the second portion extends into the second path, and while the finger guide member is in the finger guide second position the first portion extends into and blocks the first path, and further comprising, during the step of rotating the second roller in a second direction, the step of moving the finger guide member with the media sheet as the media sheet moves along the second path from the second roller toward the first roller from the finger guide member first position in the second path to the finger guide member second position out of the second path.

27. The method of claim 26, further comprising, before the step of refeeding, the steps of:

capturing the second edge of the media sheet with the first roller;

feeding the media sheet around the first roller, wherein the lead second edge of the media sheet encounters the finger guide member in the finger guide member second position blocking advancement toward the second roller, the finger guide member directing the media sheet to continue around the first roller, wherein the media sheet continues wrapping around the first roller at least until the media sheet clears the second roller; and reversing the direction of the first roller to unwrap the media sheet without the media sheet re-encountering the second roller.

28. The method of claim 27, in which a middle guide is positioned between the first roller and the second roller out of the first path, the middle guide having a first surface encountered by the media sheet as the media sheet moves along the second path, the middle guide having a second surface away from the second path adjacent to an input region, wherein the media sheet continues wrapping around the first roller at least until the media sheet clears the middle guide, and further comprising, after the step of reversing the direction of the first roller, the step of unwrapping the media sheet adjacent to the middle guide second surface at least partially into the input region.

29. A media sheet handling method for printing to two sides of a media sheet, comprising the steps of:

feeding the media sheet with a first roller along a first path onto a second roller;

rotating the second roller in a first direction to advance at least a portion of the media sheet through a print zone, wherein a first edge of the media sheet is a lead edge and a second edge of the media sheet is a trail edge during said feeding and rotating steps;

sensing the first edge of the media sheet as the lead edge with a sensor;

printing to a first side of the media sheet within the print zone during the rotating step;

sensing the second edge of the media sheet as the trail edge with the sensor;

after the step of sensing the trail edge, determining based upon the lead edge sensing and trail edge sensing when the media sheet first side printing is complete;

after said first side printing is complete, discontinuing rotation of the second roller in the first direction while a portion of the media sheet remains in contact with the second roller;

moving a refeed guide into the first path to block the first path in a region between the first roller and the second roller;

rotating the second roller in a second direction opposite the first direction to move the media sheet back toward the refeed guide, wherein the refeed guide directs the media sheet along a second path to be repicked by the first roller;

feeding the media sheet along the first roller;

sensing the second edge of the media sheet as the lead edge with the sensor;

based upon the sensing of the second edge as the lead edge determining when the first edge as the trail edge is in a desired position clear of the second roller; and after the media sheet reaches the desired position, reversing the direction of the second roller to rotate in the first direction, wherein said reversing direction of the second roller occurs before the media sheet second edge as lead edge is fed onto the second roller from the first roller for second side printing; and refeeding the media sheet from the first roller to the second roller and through the print zone;

printing to a second side of the media sheet within the print zone during the refeeding step.

30. The method of claim 29, further comprising, during the step of rotating the second roller in a second direction, the steps of:

capturing the second edge of the media sheet as the lead edge with the first roller; and wrapping the media sheet around the first roller at least until the first edge of the media sheet reaches the desired position; and further comprising, prior to the step of refeeding and after the trail edge is in the desired position, the step of reversing the direction of the first roller to unwrap the media sheet without the media sheet re-encountering the second roller.

31. A media sheet handling system, comprising:

a first roller which feeds a media sheet along a first path toward a print zone;

a second roller located along the first path between the first roller and the print zone, the second roller rotatable in a first direction and a second direction, wherein during rotation in the first direction, the second roller receives the media sheet along the first path from the first roller, and wherein during rotation in the second direction, the second roller feeds the media sheet along a second path; and a finger guide member located between the first roller and the second roller and movable between a finger guide first position which does not block the first path and a finger guide second position which does block the first path, the finger guide member biased to the finger guide first position, and wherein the finger guide member moves into the finger guide second position during movement of the media sheet along the second path.

32. The media sheet handling system of claim 31, in which the finger guide member has a first portion and a second portion, wherein the first portion extends toward the first path and the second portion extends toward the second path, and wherein while the finger guide member is in the finger guide first position the second portion extends into the second path, and while the finger guide member is in the finger guide second position the first portion extends into and blocks the first path, and wherein while the second portion extends into the second path contact with the media sheet moving along the second path pushes the finger guide member at the second portion out of the second path and from the finger guide first position into the finger guide second position.

33. A media sheet handling system for enabling printing to two sides of a media sheet, comprising the steps of:

a first roller for feeding the media sheet along a first path toward a print zone;

a second roller located between the first roller and the print zone which receives the media sheet from the first roller;

means for controlling rotational direction of the second roller to rotate in a first direction during printing to each side of the media sheet and to rotate in a second direction to redirect the media sheet toward the first roller between first side printing and second side printing; and means for blocking the media sheet from moving back along the first path after first side printing and redirecting the media sheet along a second path toward the first roller while the second roller rotates in the second direction.

34. The system of claim 33, wherein the means for redirecting the media sheet along the second path directs the media sheet toward the first roller while the second roller rotates in the second direction.

35. The system of claim 33, further comprising:

means for directing the media sheet to wrap around the first roller when the media sheet is fed from the second roller back to the first roller.

36. The system of claim 35, further comprising:

means for controlling the first roller to unwrap the media sheet along a path excluding the second roller, after the media sheet has wrapped around the first roller.

37. A media sheet handling system for enabling printing to a first side and a second side of a media sheet, comprising:

a metering roller which receives the media sheet from a feed path and moves the media sheet toward a print zone, the media sheet having a first edge and a second edge opposite the first edge;

wherein during printing to the first side of the media sheet during a duplex printing operation, the metering roller rotates in a first direction to advance the media sheet into the print zone, the metering roller discontinuing rotation in the first direction after printing to the first side is complete and while a portion of the media sheet remains in contact with the metering roller, wherein the first edge of the media sheet serves as the lead edge during printing to the first side;

a feed roller;

a refeed guide located along the feed path and between the metering roller and the feed roller, the refeed guide movable between a first position and a second position, the refeed guide biased toward the first position, wherein action of the media sheet passing over the refeed guide along the feed path moves the refeed guide into the second position;

a first signal triggering the metering roller to change direction to rotate in a second direction opposite the first direction while the portion of the media sheet remains in contact with the metering roller, wherein the metering roller moves the media sheet back toward the refeed guide while rotating in the second direction, the second edge of the media sheet being the lead edge during movement of the media sheet back toward the refeed guide, and wherein the refeed guide is positioned in the first position blocking the feed path when the second edge serving as the lead edge contacts the refeed guide during the movement of the media sheet back toward the refeed guide, the refeed guide directing the media sheet along a second path; and wherein the media sheet is fed along the second path around the feed roller to the metering roller and through the print zone to receive print onto the media sheet second side.

38. The system of claim 37, wherein the refeed guide directs the media sheet along the second path toward the metering roller.

39. The system of claim 37, further comprising an output region, wherein at least a portion of the media sheet is fed through the print zone and into the output region during printing to the media sheet first side and during printing to the media sheet second side; and wherein the media sheet is released into the output region after printing to the media sheet second side.

40. The system of claim 39, wherein the print zone is adjacent to the metering roller between the metering roller and the output region.

41. A media sheet handling method for printing to two sides of a media sheet, comprising the steps of:

receiving the media sheet from a feed path onto a metering roller;

rotating the metering roller in a first direction to advance at least a portion of the media sheet through a print zone, wherein a first edge of the media sheet is a lead edge during said receiving and rotating steps;

printing to a first side of the media sheet within the print zone during the rotating step;

after the step of printing to the first side, discontinuing rotation of the metering roller in the first direction while a portion of the media sheet remains in contact with the metering roller;

moving a refeed guide into the feed path to block the feed path;

rotating the metering roller in a second direction opposite the first direction to move the media sheet back toward the refeed guide, wherein the refeed guide directs the media sheet along a second path toward a feed roller;

refeeding the media sheet from the feed roller to the metering roller and through the print zone, wherein a second edge opposite the first edge of the media sheet is the lead edge during said refeeding step;

after the media sheet clears the metering roller during said step of rotating the metering roller in the second direction, reversing the direction of the metering roller to rotate in the first direction, wherein said reversing direction of the metering roller to the first direction occurs before the media sheet second edge is fed onto the metering roller from the feed roller; and printing to a second side of the media sheet within the print zone during the refeeding step.

42. The method of claim 41, wherein the step of printing to the first side of the media sheet comprises wet ink printing; and wherein after the step of discontinuing rotation of the metering roller in the first direction and before the step of rotating the metering roller in the second direction, there is a prescribed time delay to allow drying of the media sheet.

43. The method of claim 42, wherein at least a portion of the media sheet is fed through the print zone and into an output region during printing to the media sheet first side and during printing to the media sheet second side; wherein the media sheet resides in the output region for the prescribed drying time delay; and wherein the media sheet is released into the output region after printing to the media sheet second side.

44. The method of claim 41, further comprising, during the step of rotating the second roller in a second direction, the steps of:

capturing the second edge of the media sheet with the feed roller; and wrapping the media sheet around the feed roller at least until the media sheet clears the metering roller; and further comprising, prior to the step of refeeding, the step of reversing the direction of the feed roller to unwrap the media sheet without the media sheet re-encountering the metering roller.

45. The method of claim 44, wherein the step of reversing the direction of the feed roller comprises reversing the direction of the feed roller to unwrap the media sheet at least partially into a media chute.

46. The method of claim 41, further comprising, during the step of rotating the metering roller in a second direction, the steps of:

capturing the second edge of the media sheet with the feed roller; and retracting the media sheet from the metering roller with the feed roller; and wherein, during the step of receiving, the feed roller rotates in an original direction; and further comprising, prior to the step of refeeding, the step of reversing the direction of the feed roller from the original direction to a reverse direction to move the media sheet into a position for refeeding, wherein the media sheet is moved during the step of reversing the direction of the feed roller without encountering the metering roller; and wherein the step of refeeding comprises reversing the direction of the feed roller from the reverse direction back to the original direction.

47. The method of claim 41, wherein during the receiving the media sheet onto the metering roller, the media sheet encounters the refeed guide, wherein the refeed guide is movable between a first position and a second position and is biased into the first position; wherein during the step of receiving, the lead edge of the media sheet pushes the refeed guide into the second position; and wherein the step of moving the refeed guide to block the feed path occurs after the media sheet clears the refeed guide and the refeed guide is biased back into the first position.

48. A media sheet handling system for enabling printing to two sides of a media sheet, wherein printing occurs in a print zone, comprising the steps of:

a first roller;

a second roller located between the first roller and the print zone which receives the media sheet along a first path;

means for controlling rotational direction of the second roller to rotate in a first direction during printing to each side of the media sheet and to rotate in a second direction to redirect the media sheet toward the first roller between first side printing and second side printing; and means for blocking the media sheet from moving back along the first path after first side printing and redirecting the media sheet along a second path toward the first roller while the second roller rotates in the second direction.

49. The system of claim 48, wherein the means for redirecting the media sheet along the second path directs the media sheet toward the first roller while the second roller rotates in the second direction.

50. The system of claim 48, further comprising:

means for directing the media sheet to wrap around the first roller when the media sheet is fed from the second roller back to the first roller.

51. The system of claim 50, further comprising:

means for controlling the first roller to unwrap the media sheet along a path excluding the second roller, after the media sheet has wrapped around the first roller.

* * * * *